US010132064B2

(12) United States Patent
Myers et al.

(10) Patent No.: US 10,132,064 B2
(45) **Date of Patent: *Nov. 20, 2018**

(54) FAUCET SPRAY HEAD MAGNETIC DOCKING SYSTEMS

(71) Applicant: AS IP Holdco, LLC, Piscataway, NJ (US)

(72) Inventors: Verne H. Myers, Clinton, NJ (US); Xiaojing Ye, Edison, NJ (US); Nathan J. Wicker, Forest Park, IL (US); Walter Pitsch, Washington, NJ (US); Philip M. Anthony, III, Chicago, IL (US); Aaron B. Eiger, Chicago, IL (US)

(73) Assignee: AS IP Holdco, LLC, Piscataway, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/592,791

(22) Filed: May 11, 2017

(65) Prior Publication Data

US 2017/0314241 A1 Nov. 2, 2017

Related U.S. Application Data

(63) Continuation of application No. 15/045,904, filed on Feb. 17, 2016, now Pat. No. 9,683,353.

(Continued)

(51) Int. Cl.
*E03C 1/04* (2006.01)

(52) U.S. Cl.
CPC .... *E03C 1/0404* (2013.01); *E03C 2001/0415* (2013.01)

(58) Field of Classification Search
CPC ..... E03C 1/04

(Continued)

(56) References Cited

U.S. PATENT DOCUMENTS 5,645,302 A 7/1997 Horimoto
6,085,790 A 7/2000 Humbert et al.

(Continued)

FOREIGN PATENT DOCUMENTS

CN 2832930 11/2006
CN 201823622 5/2011

(Continued)

OTHER PUBLICATIONS

International Search Report Application No. PCT/2016/018252, International Filing Date Feb. 17, 2016, dated Apr. 14, 2016.

(Continued)

*Primary Examiner* — Lori Baker
(74) *Attorney, Agent, or Firm* — Morrison & Foerster LLP

(57) ABSTRACT

A faucet spray head magnetic docking system includes a socket that couples to an end of the spout, and a bonnet that couples to the spray head and that engages with the socket. The socket includes a shell configured to be arranged in the mouth of the spout, and integrated with one or more magnetic elements. The magnetic elements may be inserted into corresponding holes of the socket shell. Alternatively, the magnetic elements may be incorporated directly into the shell. The bonnet includes a threaded portion for coupling to corresponding threads of a connector at the spray head, and includes one or more corresponding magnets configured to magnetically attract to the magnetic elements of the socket.

27 Claims, 38 Drawing Sheets

Related U.S. Application Data

(60) Provisional application No. 62/117,662, filed on Feb. 18, 2015, provisional application No. 62/238,397, filed on Oct. 7, 2015.

(58) Field of Classification Search
USPC ..... 4/675–678
See application file for complete search history.

(56) References Cited

U.S. PATENT DOCUMENTS

| | | | |
|---|---|---|---|
| 6,738,996 | B1 | 5/2004 | Malek et al. |
| 6,915,816 | B2 | 7/2005 | Nelson et al. |
| 7,162,782 | B1 | 1/2007 | Nelson |
| 7,699,241 | B2 | 4/2010 | Benstead |
| 7,748,406 | B2 | 7/2010 | Pilatowicz et al. |
| 7,753,079 | B2 | 7/2010 | Nelson |
| 7,891,637 | B2 | 2/2011 | Zimmermann |
| 7,909,061 | B2 | 3/2011 | Nelson |
| 8,061,631 | B2 | 11/2011 | Lev |
| 8,152,078 | B2 | 4/2012 | Jianglin et al. |
| 8,342,577 | B2 | 1/2013 | Schoenoff et al. |
| 8,376,248 | B2 | 2/2013 | Meisner |
| 8,387,661 | B2 | 3/2013 | Nelson |
| 8,413,686 | B2 | 4/2013 | Ko |
| 8,496,028 | B2 | 7/2013 | Nelson et al. |
| 8,567,430 | B2 | 10/2013 | Allen et al. |
| 8,713,725 | B2 | 5/2014 | Alder et al. |
| 8,727,241 | B2 | 5/2014 | Bosio |
| 8,776,836 | B2 | 7/2014 | Ragner et al. |
| 8,800,075 | B2 | 8/2014 | van Leyen et al. |
| 8,875,738 | B2 | 11/2014 | Yang et al. |
| 9,181,685 | B2 | 11/2015 | Esche et al. |
| 9,284,723 | B2 | 3/2016 | Esche et al. |
| 9,683,353 | B2 * | 6/2017 | Myers ..... E03C 1/0404 |
| 2006/0283511 | A1 | 12/2006 | Nelson |
| 2008/0185060 | A1 | 8/2008 | Nelson |
| 2008/0276367 | A1 | 11/2008 | Bares et al. |
| 2009/0007330 | A1 | 1/2009 | Genord et al. |
| 2010/0170587 | A1 | 7/2010 | Kaess |
| 2010/0170588 | A1 | 7/2010 | Nelson |
| 2010/0237166 | A1 | 9/2010 | Nelson |
| 2011/0162743 | A1 | 7/2011 | Nelson |
| 2012/0153050 | A1 | 6/2012 | Bosio |
| 2013/0180601 | A1 | 7/2013 | Li et al. |
| 2013/0299608 | A1 | 11/2013 | Spangler et al. |
| 2013/0320116 | A1 | 12/2013 | Jonte et al. |
| 2014/0020767 | A1 | 1/2014 | Nelson et al. |
| 2014/0026980 | A1 | 1/2014 | Esche et al. |
| 2014/0069520 | A1 | 3/2014 | Esche et al. |
| 2014/0166124 | A1 | 6/2014 | Davidson et al. |
| 2014/0251451 | A1 | 9/2014 | Yang et al. |
| 2014/0352799 | A1 | 12/2014 | Rosko et al. |
| 2015/0368887 | A1 | 12/2015 | Esche et al. |
| 2016/0160482 | A1 | 6/2016 | Esche et al. |

FOREIGN PATENT DOCUMENTS

| | | |
|---|---|---|
| GB | 2461139 | 12/2009 |
| WO | WO2006138124 A2 | 12/2006 |

OTHER PUBLICATIONS

Brizo's Magnedock® Technology: http://www.brizo.com/technology/magnedock.html#VJCSC_nF91Q, retrieved Dec. 16, 2014.

Delta's Magnatite® Docking Technology: http://www.deltafaucet.com/smart-solutions/magnatite-docking.html, retrieved Dec. 16, 2014.

Yanko Design's Funky Flexible Faucet: http://www.yankodesign.com/2014/04/17/funky-flexible-faucet/, retrieved Dec. 16, 2014.

Kohler. (2014). "Sensate Touchless Pull-Down Kitchen Sink Faucet," located at <http://www.us.kohler.com/us/Sensate%E2%84%A2-touchless-pull-down-kitchen—sink-faucet/productDetail/Kitchen-Sink-Faucets/825440.htm> visited on Dec. 16, 2014. (3 pages).

Faucet.com. (2014). Hansgrohe's MagFit Sprayhead Docking located at <http://www.faucet.com/hansgrohe-14877-chrome-talis-s-pull-down-kitchen-fa- ucet-with-higharc-spout-magnetic-docking-non-locking-spray-diverter/f1655479> visited on Dec. 16, 2014. (2 pages).

Myers et al., U.S. Office Action dated Nov. 17, 2016, directed to U.S. Appl. No. 15/045,904; 11 pages.

Examination Report dated Jun. 27, 2018, directed to NI Application No. 2017-00099 I; 8 pages.

* cited by examiner

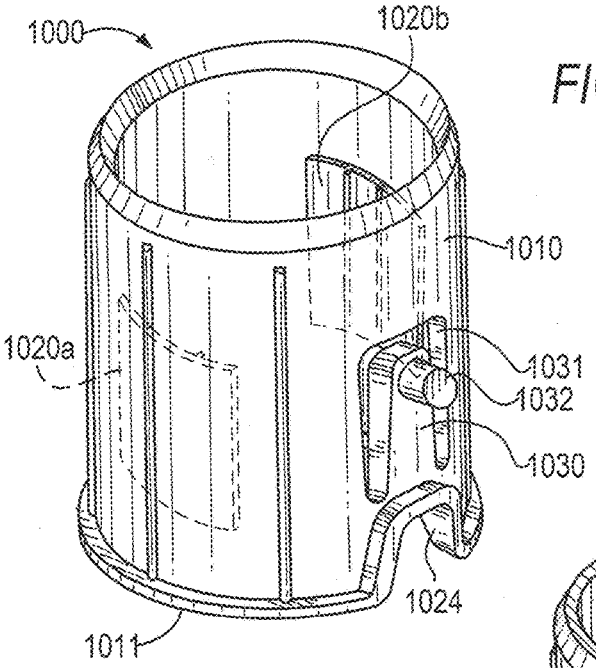
FIG. 10
FIG. 10a
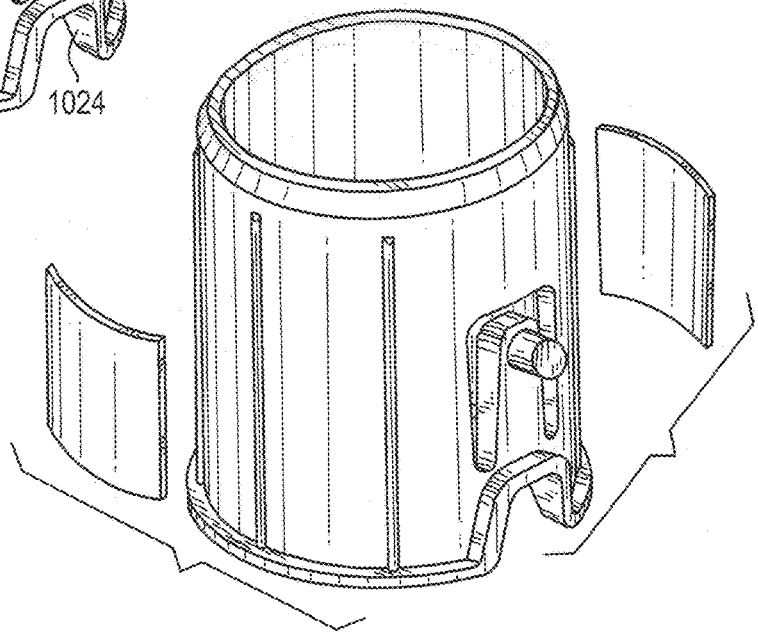
FIG. 11
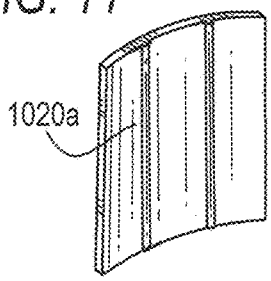
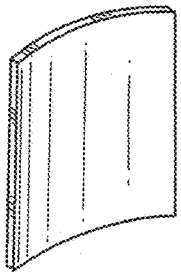
FIG. 11a

FIG. 17c
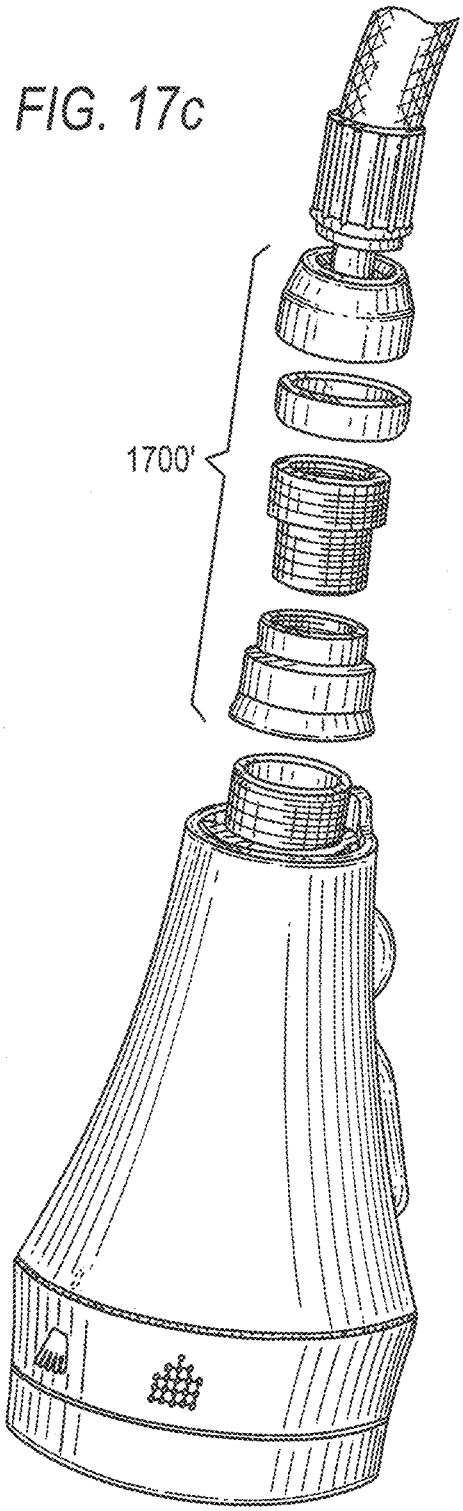
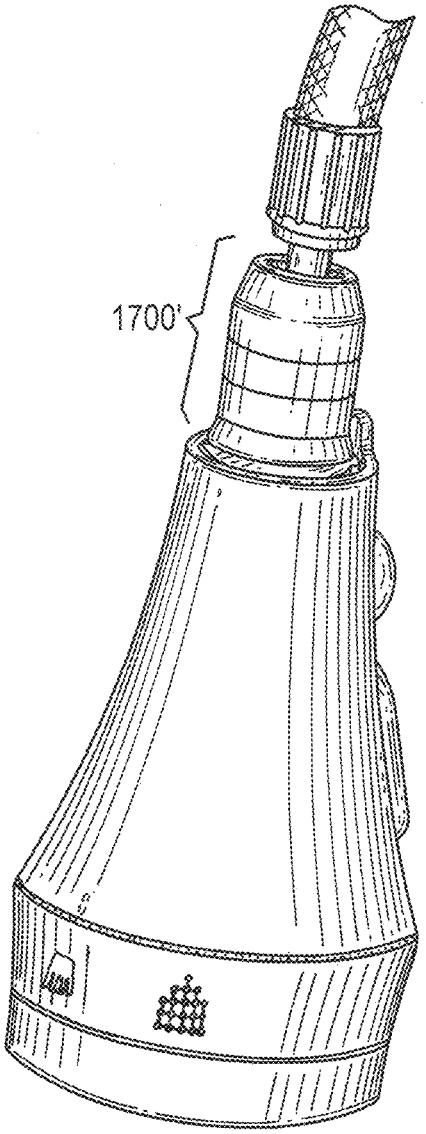
FIG. 17d

FAUCET SPRAY HEAD MAGNETIC DOCKING SYSTEMS

CROSS-REFERENCE TO RELATED PROVISIONAL APPLICATIONS

This application is a continuation of U.S. application Ser. No. 15/045,904, filed on Feb. 17, 2016 which claims the benefit of U.S. Provisional Application No. 62/117,662, filed on Feb. 18, 2015, and U.S. Provisional Application No. 62/238,397, filed on Oct. 7, 2015, the disclosures of which are hereby incorporated by reference herein in their entireties.

FIELD OF THE INVENTION

The present invention generally relates to faucets with pull-out spray heads.

BACKGROUND OF THE INVENTION

Faucets are extremely common plumbing products with a basic purpose of delivering hot, cold or mixed water from a water supply to a user. Some faucets, especially kitchen faucets, feature pull-down or pull-out spray mechanisms, which include spray heads attached to flexible and retractable hoses disposed in the faucet spouts to direct water through the spouts to the spray heads. These faucets provide users with more flexibility in directing water output, allowing them to rinse areas of the sink or undersides of dishware that water output from fixed faucet types might be unable to reach.

After use of a pull-out spray head is complete, it is normally docked into the mouth of the faucet spout. To achieve this, one type of conventional pull-out faucet employs a weight (attached to the back end of the hose) that drags the hose downward underneath the sink, forcing the spray head to move toward the spout and dock thereto. However, optimal retraction of the hose and secure docking of the spray head are often difficult to achieve—even a slight misplacement of the weight can obstruct the hose during retractions and cause the spray head to undesirably dangle about the spout.

SUMMARY OF THE INVENTION

Generally speaking, it is an object of the present invention to provide new faucet spray docking systems that avoid the disadvantages of conventional constructions.

According to some embodiments of the present invention, a faucet can include a faucet body, a spout attached to the faucet body, a hose disposed through the faucet body and the spout, a pull-out spray head fluidly coupled to the hose, and a magnetic docking system that removably couples the pull-out spray head to the spout. The magnetic docking system can include a sleeve or socket arranged at an end of the spout and a bonnet that couples to the spray head and engages the socket. The socket can include a shell or outer surface provided with one or more magnetic elements. In some embodiments, the magnetic elements may be permanent magnets. In other embodiments, the magnetic elements may be ferromagnetic materials capable of magnetically coupling to one or more permanent magnets. The bonnet can include a threaded portion for coupling to corresponding threads of a connector at the spray head and one or more permanent magnets or ferromagnetic members configured to magnetically couple to the magnetic elements of the socket.

According to some embodiments of the present invention, a faucet can include a magnetic docking system having a first ring-shaped magnet arranged at or near the end of the spout and a second ring-shaped magnet disposed at a docking end of a pull-out spray head, capped by a spray-head adaptor. The spray-head adaptor may be fluidly coupled to an end of a hose disposed in the spout and insertable into the end of the spout to which the spray head docks. The magnetic attraction between the first ring-shaped magnet and the second ring-shaped magnet can removably couple the spray head to the spout in its docked position.

Still other objects and advantages of the present invention will in part be obvious and will in part be apparent from the disclosure.

The present invention accordingly comprises the features of construction, combinations of elements, and arrangement of parts, all as exemplified in the constructions herein set forth, and the scope of the invention will be indicated in the claims.

BRIEF DESCRIPTION OF THE DRAWINGS

FIGS. 10 and 10*a* are perspective views of exemplary embodiments of a socket;

FIGS. 11 and 11*a* are perspective views of exemplary embodiments of a magnetic coupling element for the socket embodiments of FIGS. 10 and 10*a;*

FIGS. 17*a* and 17*c* are disassembled perspective views of exemplary embodiments of a bonnet of a magnetic docking system;

FIGS. 17*b* and 17*d* are assembled perspective views of the bonnet embodiments of FIGS. 17*a* and 17*c;*

DETAILED DESCRIPTION OF THE PREFERRED EMBODIMENTS

Given that slight misplacement of a hose weight in a typical pull-out style faucet can prevent the spray head from being properly docked, it is advantageous to employ a separate magnetic docking system to do so.

Figure 1:
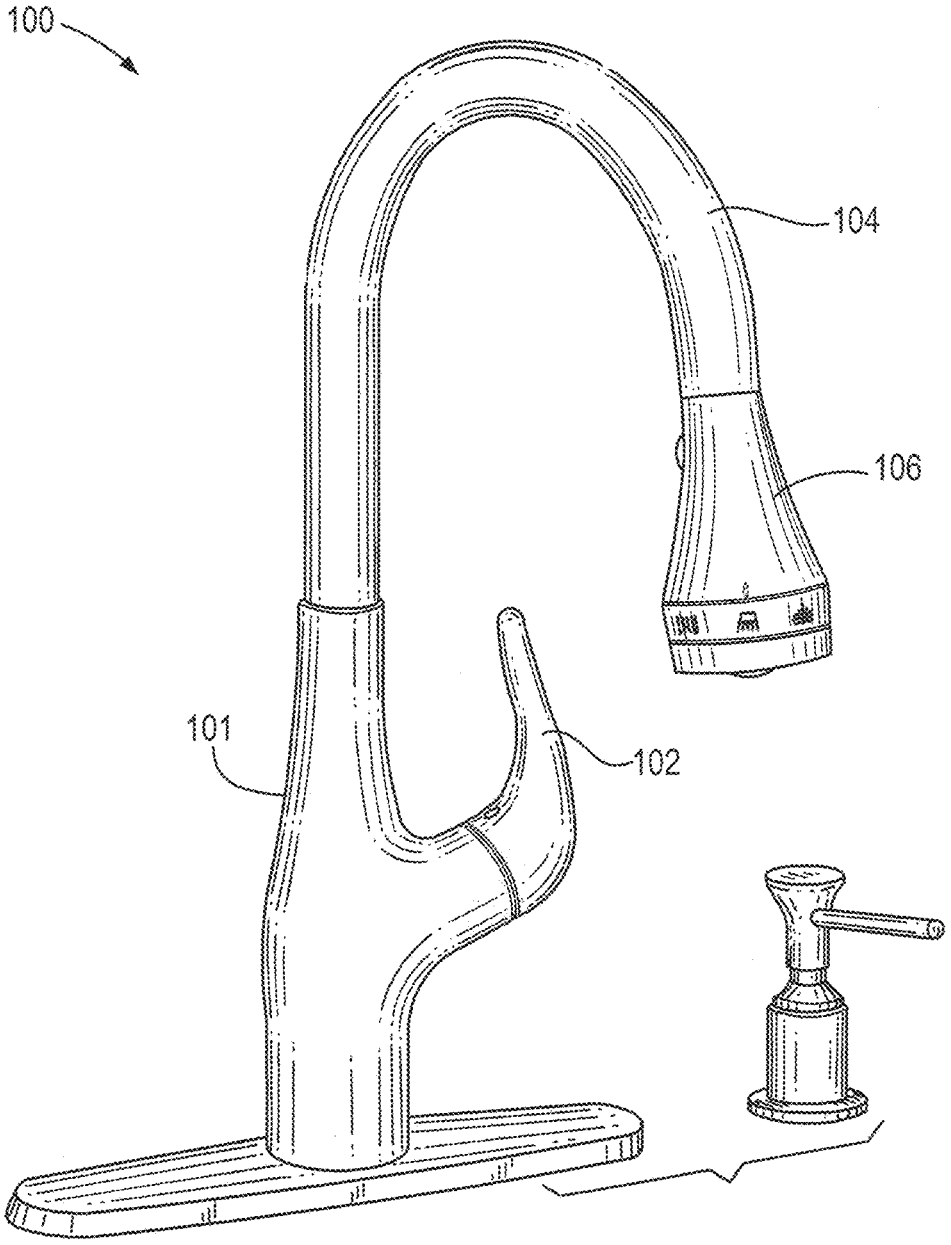
FIG. 1 is a perspective view of an exemplary pull-out faucet according to an embodiment of the present invention.

FIG. 1 is a perspective view of a pull-out faucet 100 according to an embodiment of the present invention. Faucet 100 includes a faucet body 101, a handle 102, a spout 104 connected to faucet body 101, a pull-out hose (not visible in FIG. 1) extending through spout 104, and a spray head 106 fluidly coupled to the hose. The hose is configured to provide water through the spout to the spray head, and is constructed from material that is flexible enough to allow it to traverse through the spout when the spray head is displaced between its docked and undocked positions. FIG. 1 shows spray head 106 in its docked position.

According to some embodiments, a faucet (e.g., faucet 100 of FIG. 1) can incorporate a magnetic docking system for removably coupling the pull-out spray head to the spout. The magnetic docking system can include a sleeve or socket arranged at an end of the spout and a bonnet coupled to a docking end of the spray head that may be configured to magnetically couple with the socket when the bonnet is inserted therein. The socket and the bonnet can each be composed of any suitable material (e.g., plastic, metal, or the like). FIGS. 2*a*, 2*e*, 2*b*, and 2*f* are perspective and side views of embodiments of a socket (200, 200') of a magnetic docking system. Socket 200 can include an outer surface or shell 210 having magnetic coupling elements 220*a* and 220*b* integrated therein. Magnetic coupling elements 220*a* and 220*b* may be integrated into socket 200 using any suitable method, including, for example, incorporating magnetic coupling elements 220*a* and 220*b* into socket 200 during an insert molding process or press-fitting, or otherwise adhering magnetic coupling elements 220*a* and 220*b* to socket 200 after socket 200 is formed. Shell 210 can be composed of plastic or any other suitable material, and can have a shape (e.g., cylindrical) configured to conform to the inner surface at an end of a spout (e.g., spout 104 of FIG. 1).

Figure 2A:
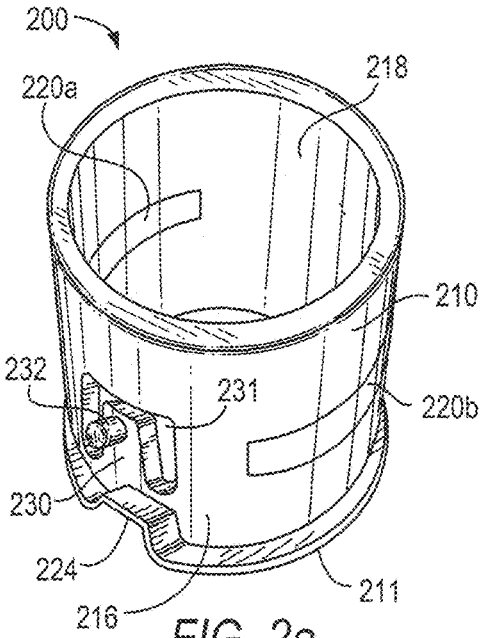
FIGS. 2*a*-2*h* are various views of exemplary embodiments of a socket of a magnetic docking system.
Figure 2B:
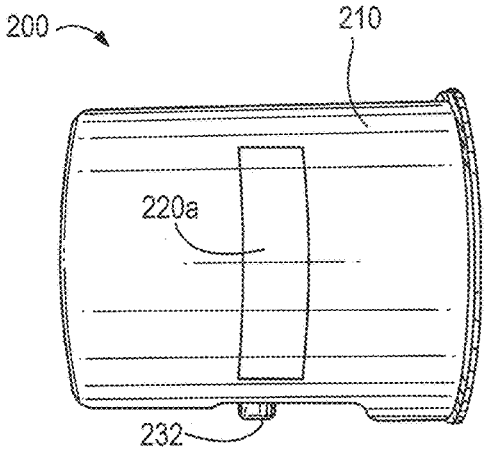
Figure 2C:
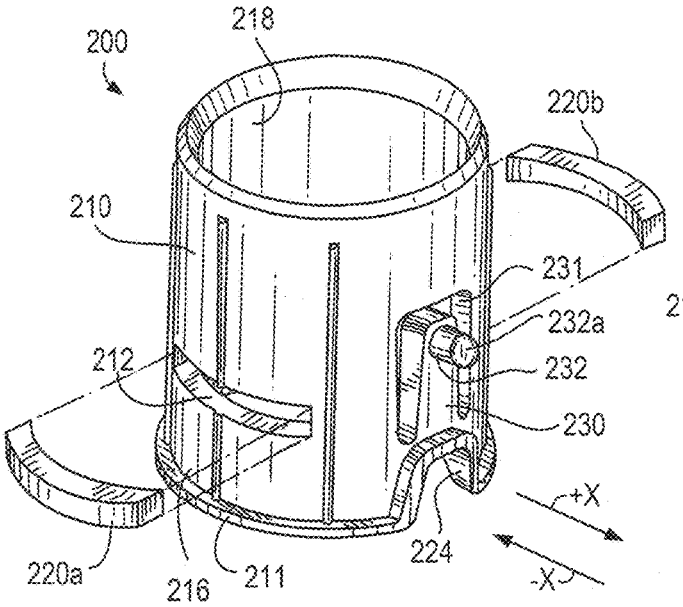
Figure 2D:
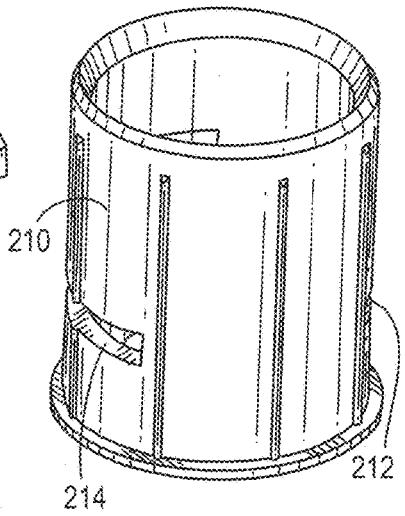
Figure 2F:
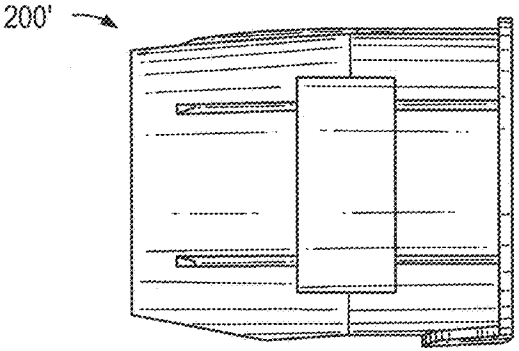
Figure 2H:
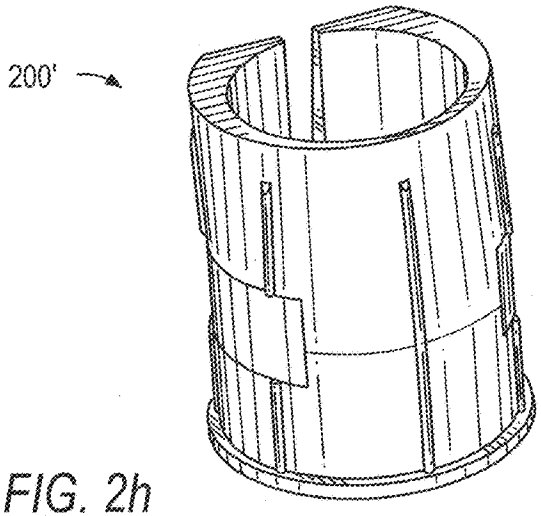
Figure 2E:
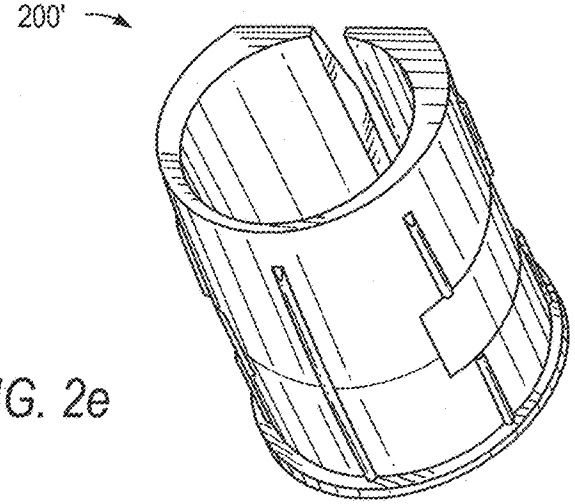
Figure 2G:
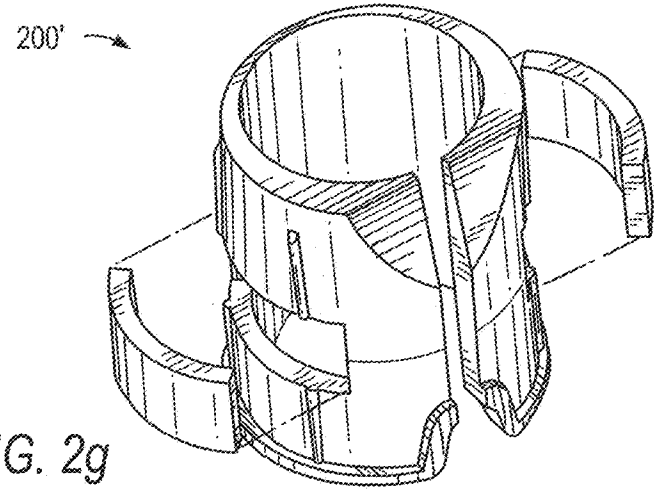

FIGS. 2*c*, 2*d*, 2*g*, and 2*h* are disassembled perspective views of the socket embodiments of FIGS. 2*a*, 2*b*, 2*e*, and 2*f*. As shown in FIGS. 2*c* and 2*d*, shell 210 can include apertures 212 and 214 into which magnetic coupling elements 220*a* and 220*b* can be respectively inserted and secured (e.g., via press fitting and/or any other suitable adhesive mechanism). Magnetic coupling elements 220*a* and 220*b* can be fitted into the holes such that the coupling elements extend at least partially from an outer surface 216 to an inner surface 218 of shell 210. Shell 210 can also include a slot 224 for receiving an alignment feature at the base of the spray head (described in more detail below). As shown in FIGS. 2*e*, 2*g*, and 2*h*, socket 200' can include a longitudinal slit or gap defined in its shell or outer surface. In various embodiments, the slit or gap can be configured to receive and/or pass a complementary component (e.g., a male component) disposed in an interior portion of a faucet spout. Socket 200' can also include one or more chamfers adjacent the gap.

Shell 210 can also include a base portion 211 that is slightly larger than the circumference of outer surface 216 (as well as the circumference of the inner surface of the spout end), and that functions as a stopping mechanism during insertion of the socket into the spout. In order to secure socket 200 within the spout, shell 210 can include a clip member 230 and an engagement member 232, which may be a knob, ridge, or flange, for example, disposed on clip member 230. Clip member 230 can be formed during the injection molding process of shell 210 such that a gap 231 separates multiple sides of clip member 230 from adjacent portions of shell 210. Gap 231 allows clip member 230 to deflect in the +X and −X directions shown in FIG. 2*c*. Engagement member 232 extends from outer surface 216, at clip member 230, in the +X direction to engage, for example, a complementary feature, such as a notch, formed on or in an inner surface of the spout. In order to lock engagement member 232 in the spout, the length of engagement member 232 may be sufficient to extend beyond outer surface 216 of shell 210. In this configuration, when socket 200 is inserted into the spout, the inner surface of the spout applies a force onto engagement member 232 in the −X direction, thereby deflecting clip member 230 in the −X direction and causing clip member 230 and engagement member 232 to apply a counter-force in the +X direction.

Figure 3A:
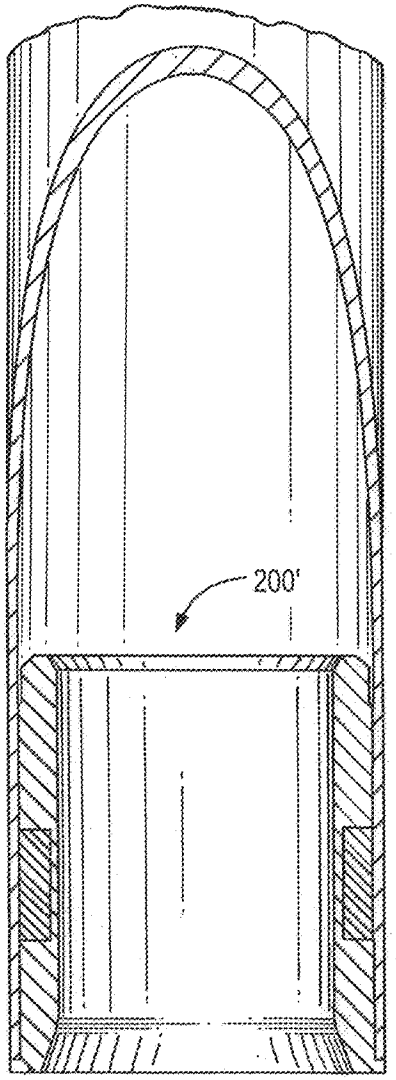
FIGS. 3 and 3*a* are cross-sectional views of spouts having the socket embodiments of FIGS. 2*a*-2*h* inserted therein.
Figure 3:
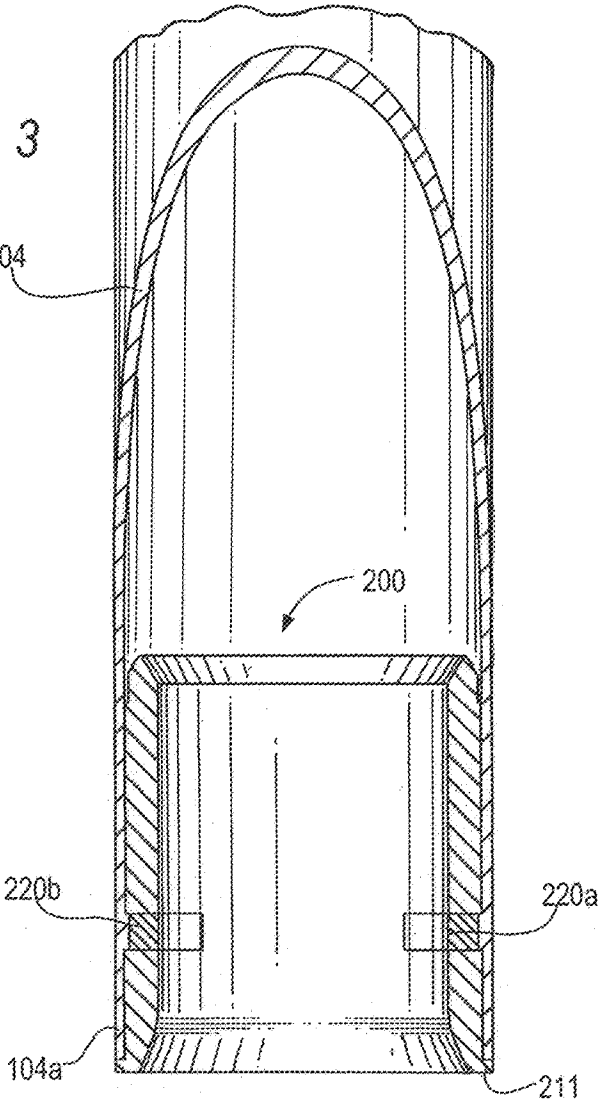

When fully engaged in the spout, engagement member 232 can mate with the complementary notch to retain socket 200 in the spout. In other embodiments, socket 200 can be retained in the spout using a press fit that obviates the need for a notch to mate with engagement member 232. FIGS. 3 and 3*a* are cross-sectional views of the socket embodiments of FIGS. 2*a*-2*h*. For example, FIG. 3 shows socket 200 after it is inserted into an end 104*a* of spout 104.

Figure 4A:
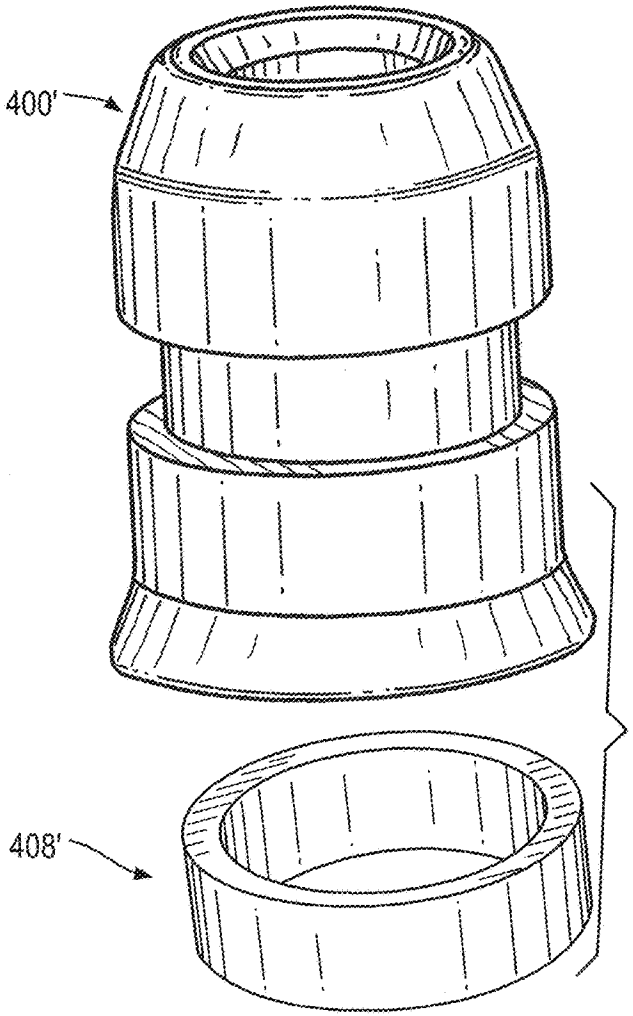
FIGS. 4 and 4*a* show exemplary embodiments of a bonnet of a magnetic docking system.
Figure 4:
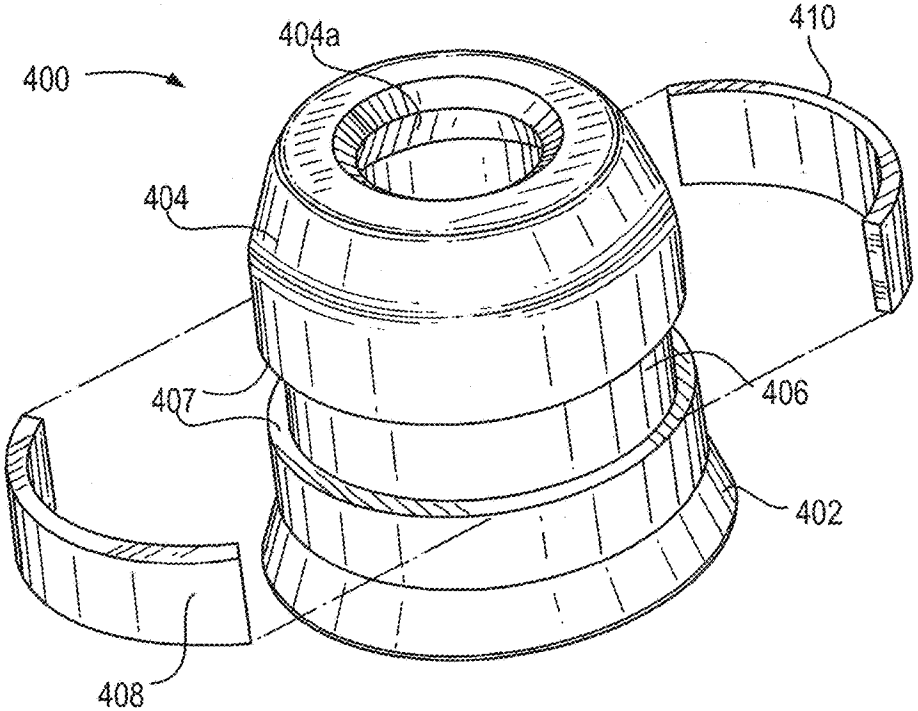

FIGS. 4 and 4*a* show embodiments of a bonnet (400, 400'). Bonnet 400 can be configured to fluidly couple to a spray head (e.g., spray head 106 of FIG. 1) and a hose. Bonnet 400 can be included as part of the hose or the spray head, and can magnetically couple the spray head to socket 200 in order to improve and/or facilitate docking of the spray head in the spout. Bonnet 400 can include a base 402, a cap 404, and a neck 406 that joins the base to the cap so as to form a groove 407. Bonnet 400 can also include one or more magnetic coupling elements 408 and 410 that can be situated in groove 407. Although only two magnetic coupling elements are depicted in FIG. 4, one skilled in the art would appreciate that any suitable number of magnetic coupling elements may be used. Magnetic coupling elements 408 and 410 may be permanent magnets or any other ferromagnetic material capable of magnetically coupling to corresponding magnetic elements of a magnetic docking system (e.g., magnetic coupling elements 220*a* and 220*b* of FIGS. 2*a*-2*d* and 3). Although they are shown in FIG. 4 as being separate from bonnet 400, magnetic coupling elements 408 and 410 (either as distinct components or as a single annular component) may be secured in groove 407 after bonnet 400 is fully formed (e.g., using a press-fit and/or an adhesive). As shown in FIG. 4*a*, bonnet 400' can include an annular magnetic coupling element 408' configured to be disposed about a neck of the bonnet.

Magnetic coupling elements 408 and 410 may or may not fully encircle neck 406 when disposed in groove 407. In some embodiments, portions of neck 406 may be exposed when magnetic coupling elements 408 and 410 are situated in groove 407. In other embodiments, magnetic coupling elements 408 and 410 may fully encircle neck 406 when arranged in groove 407, leaving little to no portion of neck 406 exposed. In yet another embodiment, a single ring-shaped magnetic coupling element can be disposed around neck 406.

Figure 5A:
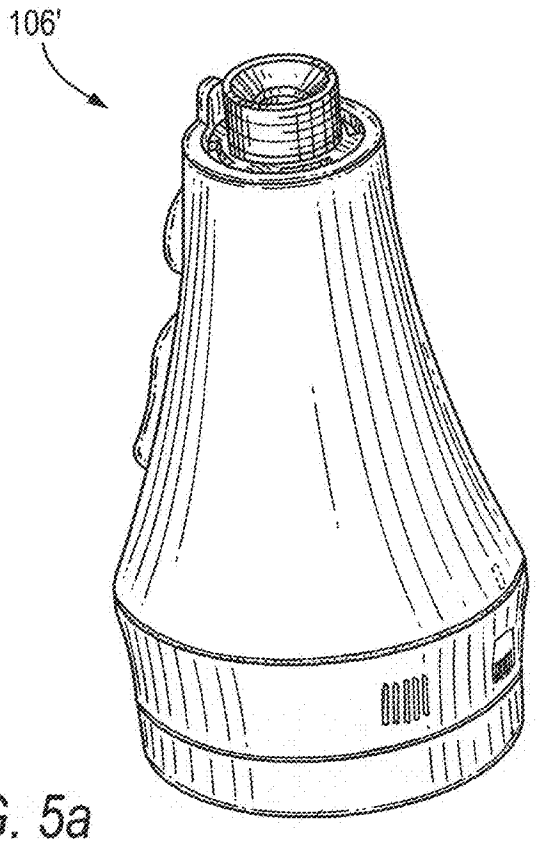
FIGS. 5 and 5*a* are perspective views of exemplary embodiments of a spray head.
Figure 5:
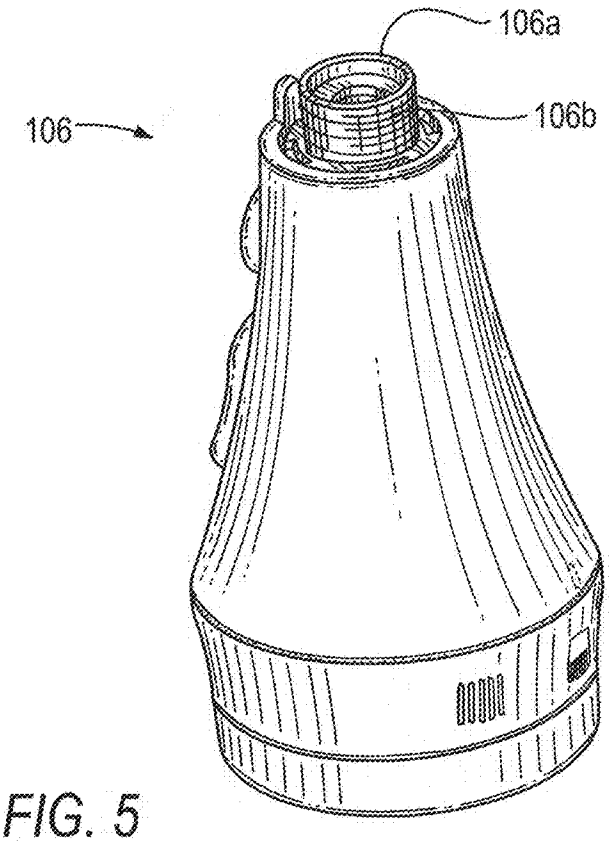
Figure 6A:
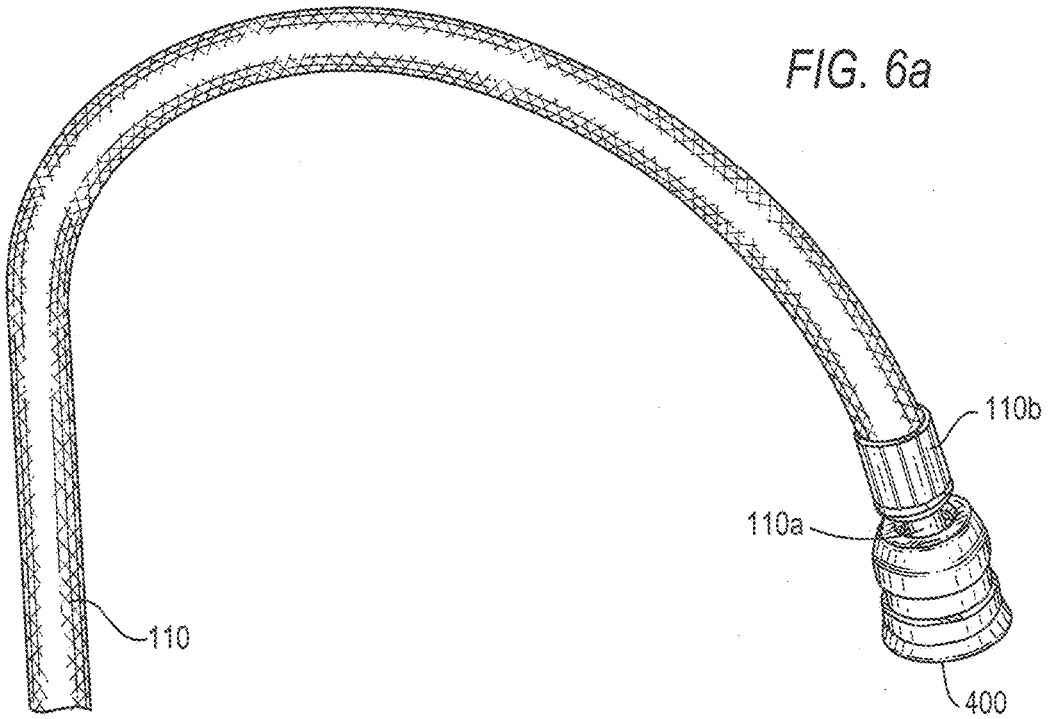
FIGS. 6*a*-6*d* are perspective views of exemplary embodiments of a hose coupled to the bonnet embodiments of FIGS. 4 and 4*a;*
Figure 6B:
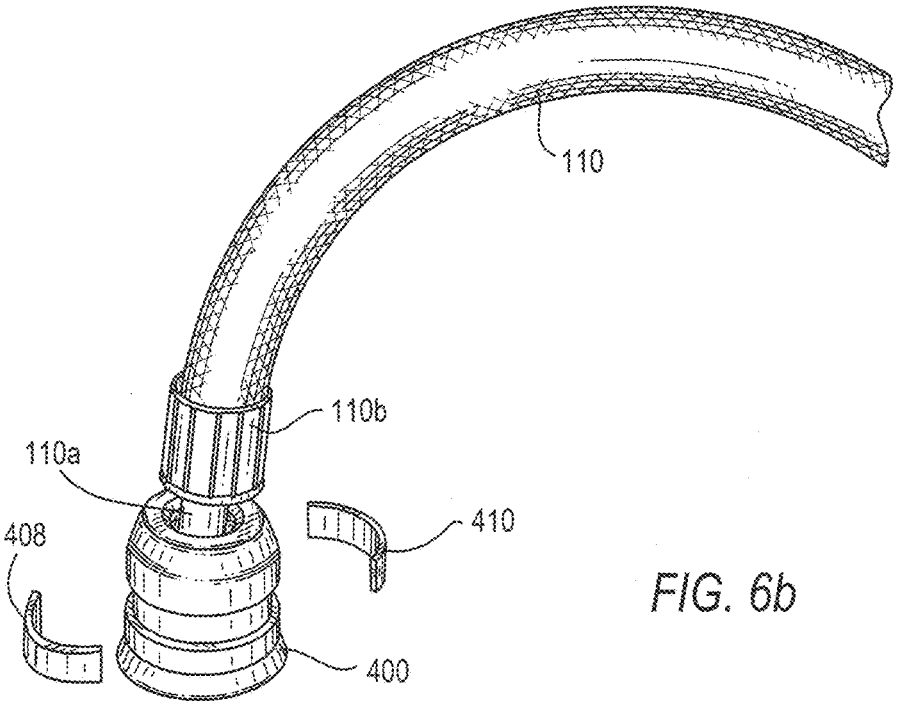
Figure 6C:
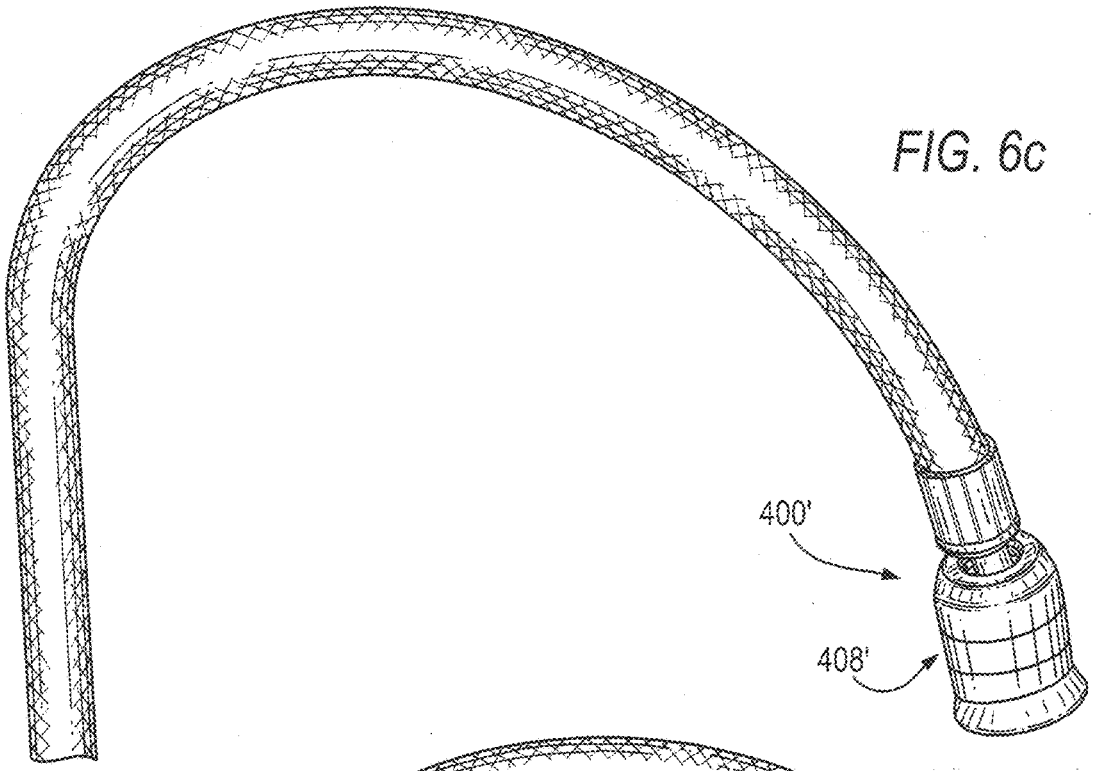
Figure 6D:
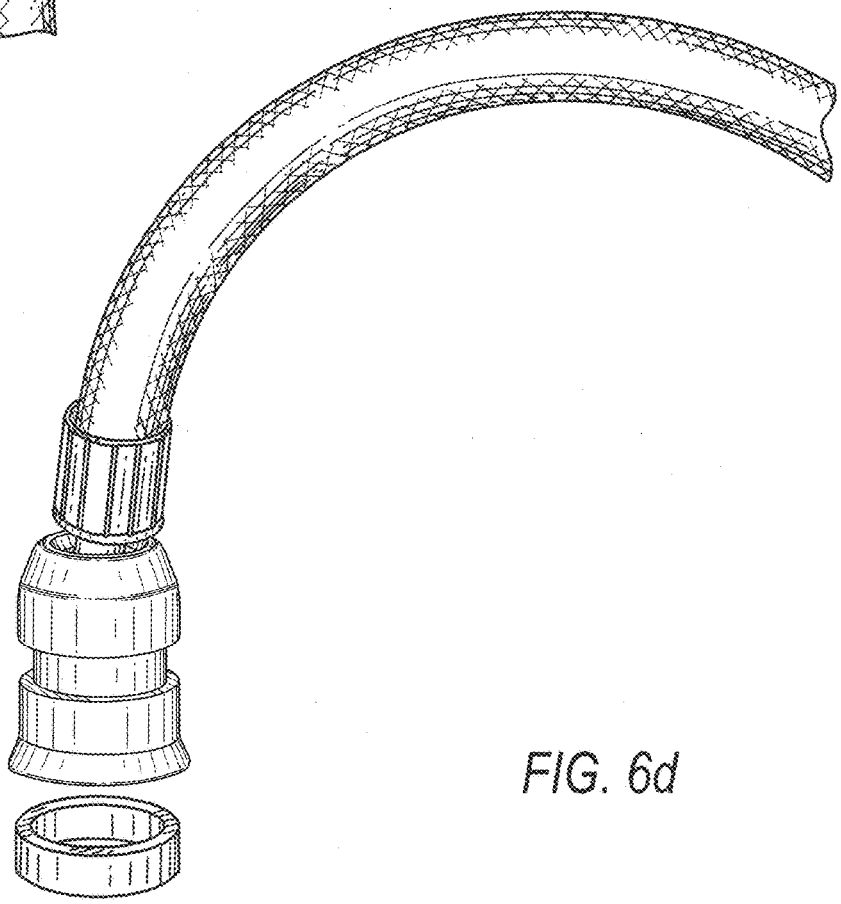

Bonnet 400 may include a threaded bore (see threaded bore 403 of FIG. 7) that functions as a female connector for coupling to a corresponding threaded male connector of a spray head (see the spray head embodiments, i.e., 106, 106', of FIGS. 5 and 5*a*). Spray head 106 can include a male connector 106*a* having threads 106*b* for threadably coupling to the threaded bore of bonnet 400.

Cap 404 of bonnet 400 can also include an aperture 404*a* configured to receive and retain a ball joint of a hose, such as the hose of faucet 100, for example, to facilitate swiveling of spray head 106 with respect to the hose.

FIGS. 6*a*-6*d* are perspective views of embodiments of a hose coupled to the bonnet embodiments of FIGS. 4 and 4*a*. Hose 110, which may be disposed through spout 104 of faucet 100, can include a crimped ball joint 110*a* at a hose end 110*b*. Crimped ball joint 110*a* can include a passage that allows water to flow from hose 110, through bonnet 400 and out a tap of spray head 106. Crimped ball joint 110*a* may be disposed at least partially within bonnet 400 such that the interaction between crimped ball joint 110*a* and aperture 404*a* allows the spray head to swivel about hose end 110*b*.

Figure 7:
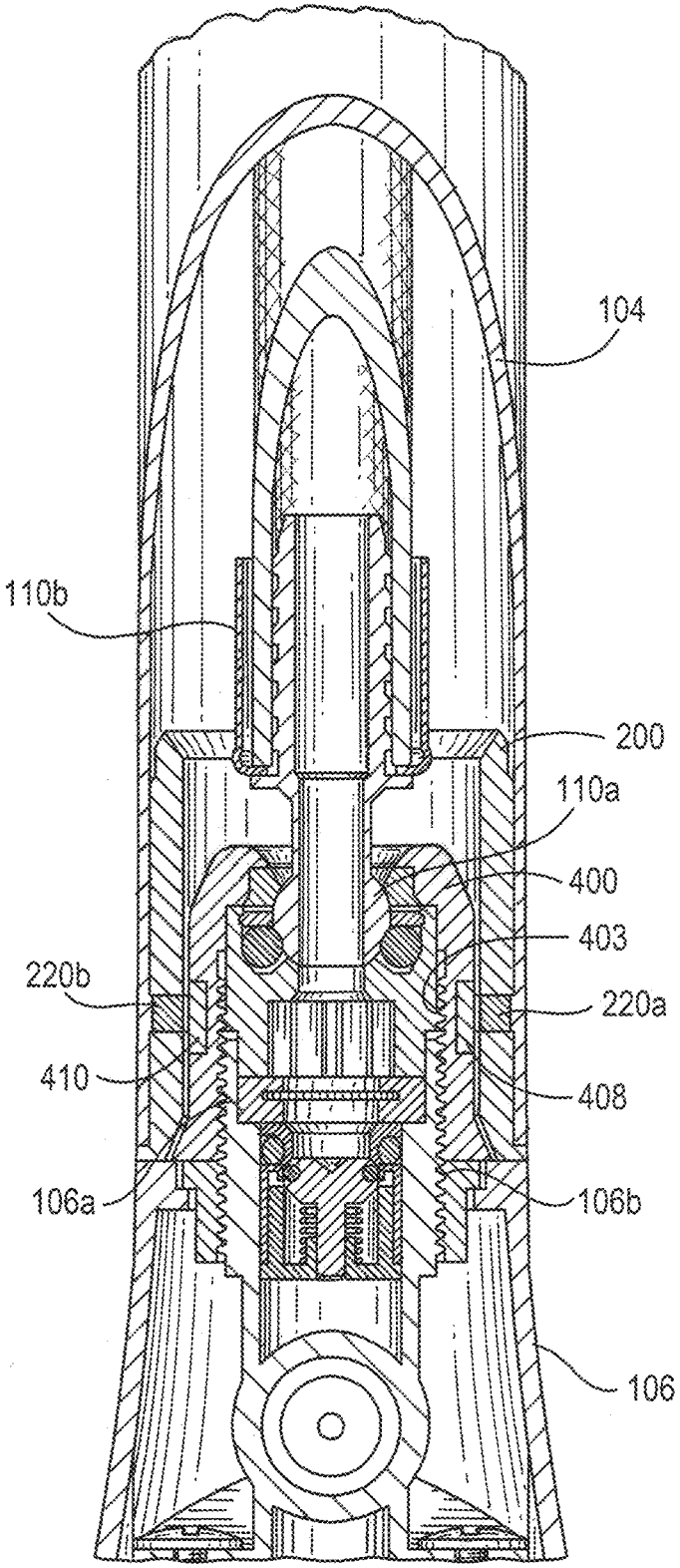
FIGS. 7 and 7*a* are cross-sectional views of the spray head embodiments of FIGS. 5 and 5*a* in docked positions.
Figure 7A:
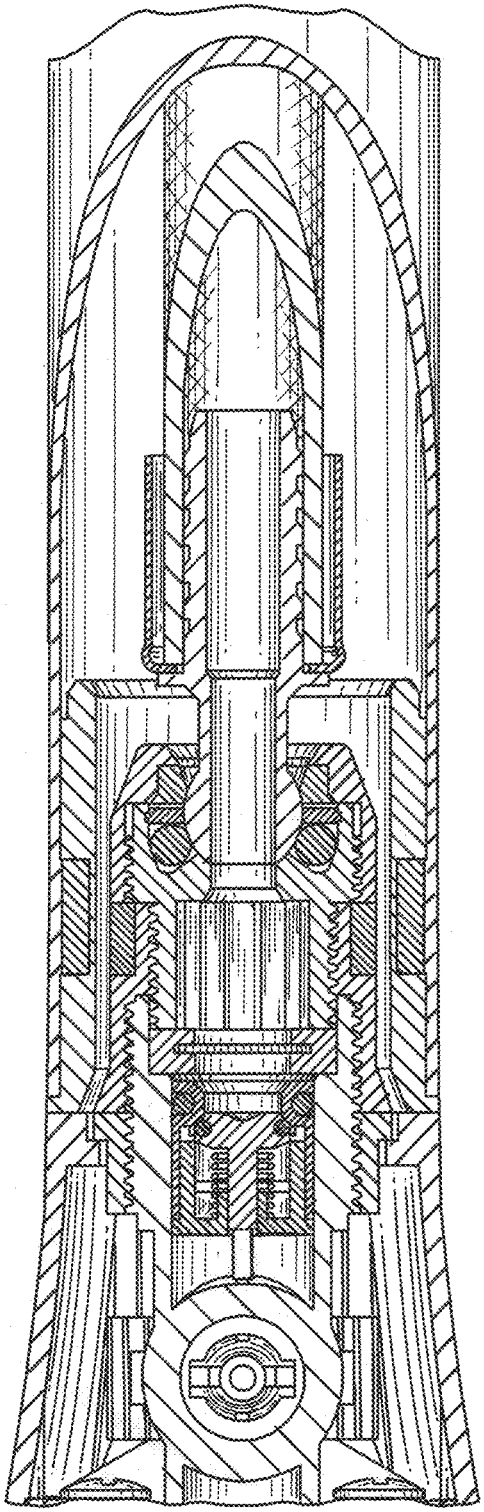

FIGS. 7 and 7*a* are cross-sectional views of the spray head embodiments of FIGS. 5 and 5*a* in docked positions. As shown in FIG. 7, spray head 106 can be coupled to bonnet 400 and hose 110 in its docked position. Additionally, spray head 106, bonnet 400, and socket 200 can be aligned with one another such that, when bonnet 400 is inserted into or engages socket 200, magnetic coupling elements 408 and 410 can be situated proximate to, or otherwise aligned with, magnetic coupling elements 220*a* and 220*b*, thereby magnetically docking spray head 106 to spout 104. The strength of attraction between magnetic coupling elements 220*a* and 220*b* and magnetic coupling elements 408 and 410 may be chosen such that spray head 106 remains firmly docked to spout 104 in its docked position, but can be undocked easily from spout 104 when needed. As is also shown in FIG. 7, threads 106*b* of spray head 106 are coupled to threaded bore 403 of bonnet 400 such that the spray head is fixed to the bonnet and displaces therewith during undocking.

Figure 8:
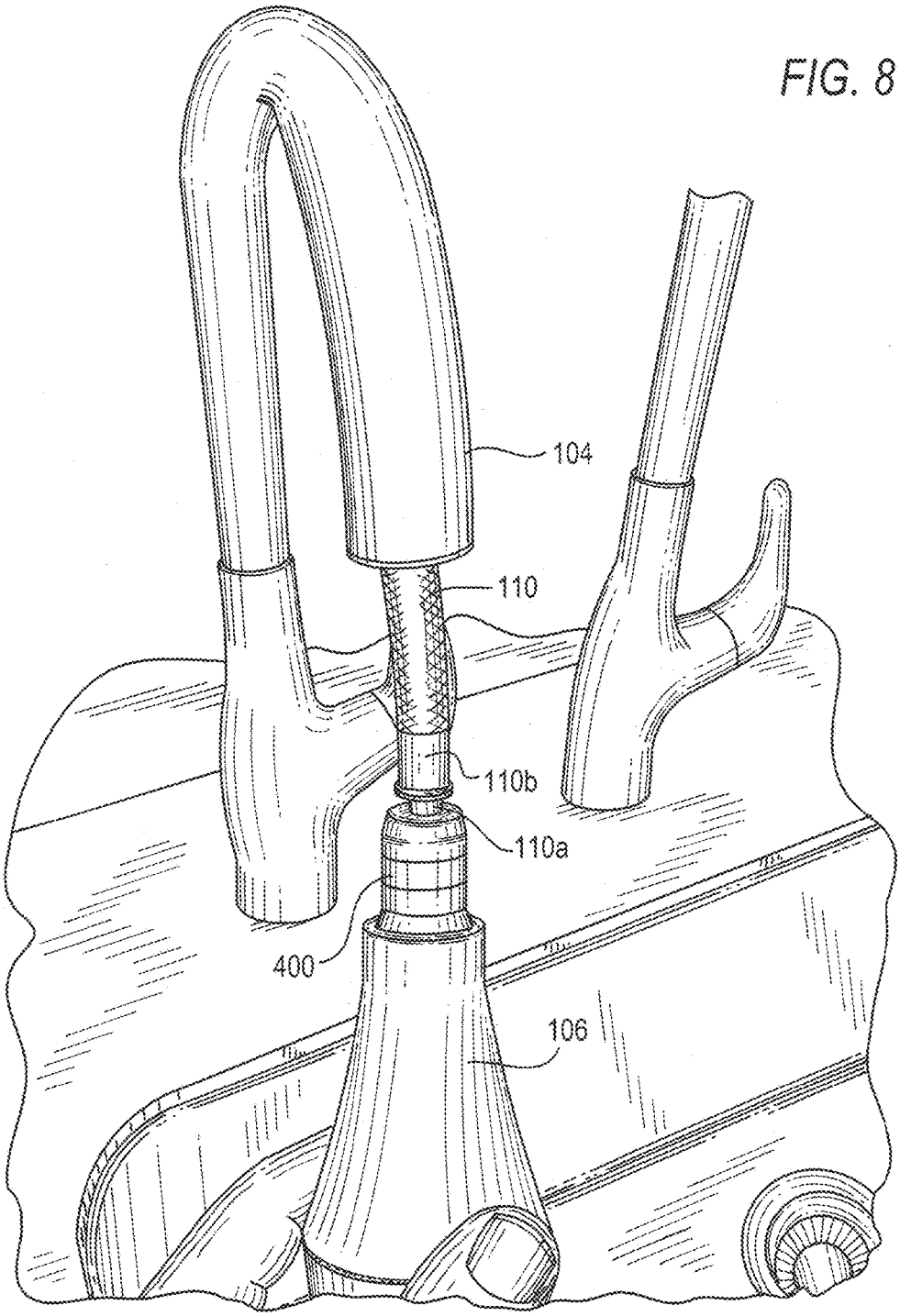
FIGS. 8 and 8*a* are perspective views of the spray head embodiments of FIGS. 5 and 5*a* in undocked positions.
Figure 8A:
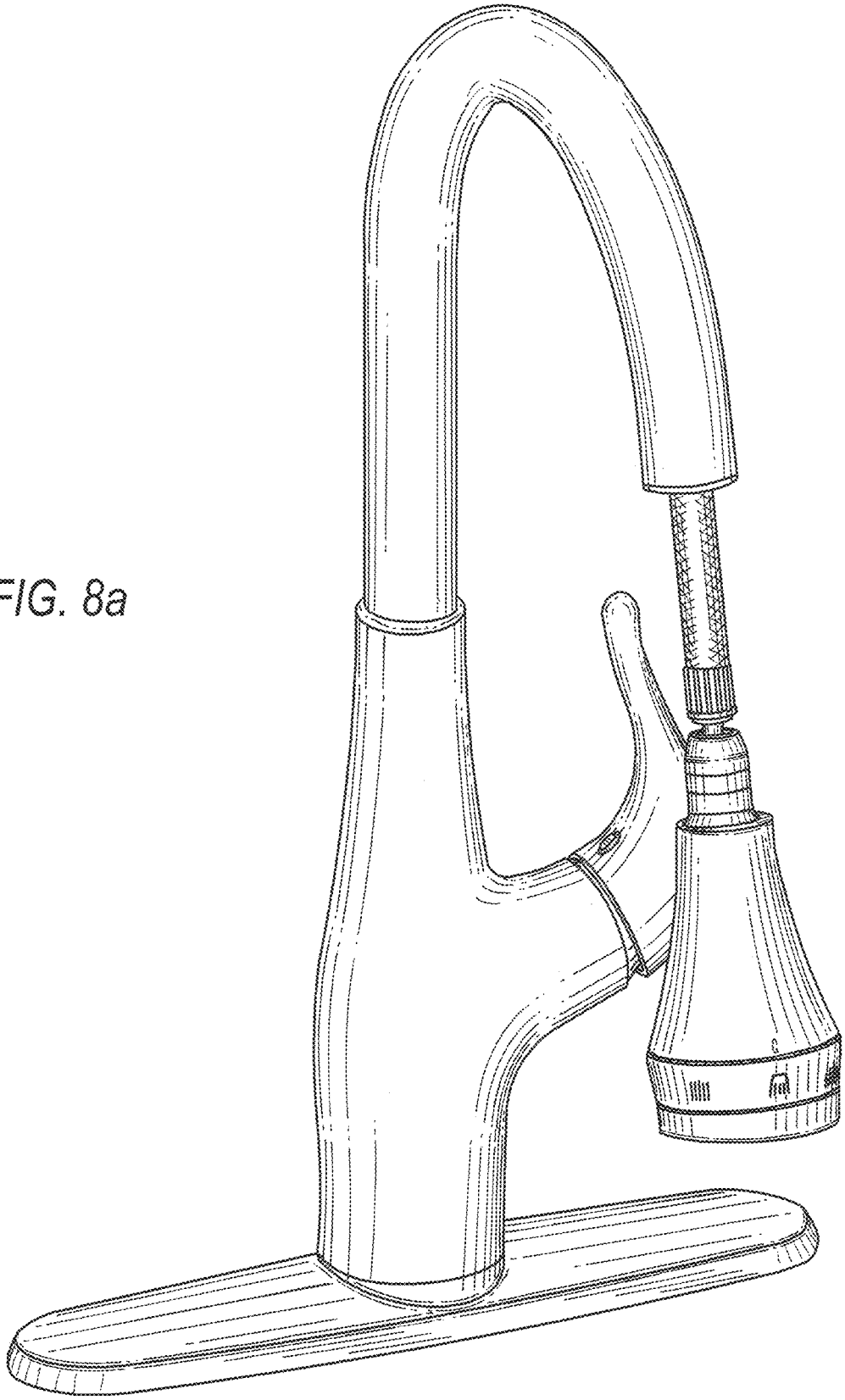

FIGS. 8 and 8*a* are perspective views of the spray head embodiments of FIGS. 5 and 5*a* in undocked positions. As shown in FIG. 8, bonnet 400 is coupled to spray head 106, and the two components move together when undocked.

Figure 9A:
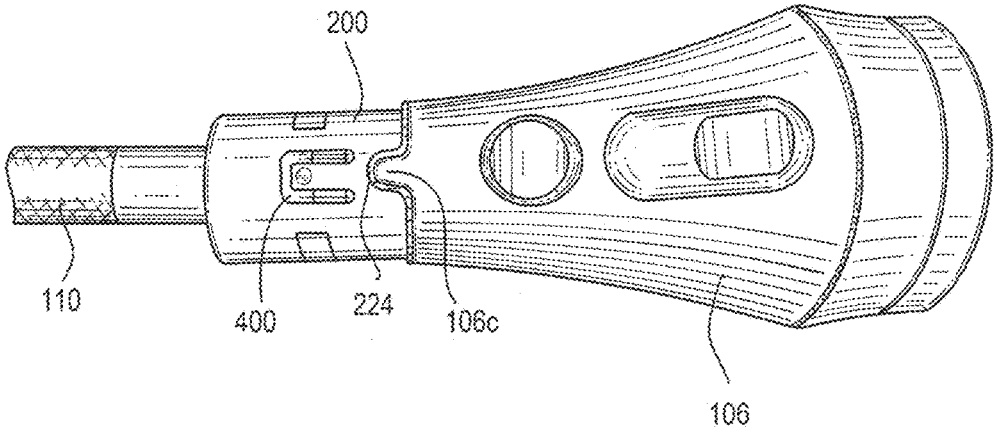
FIGS. 9*a*-9*d* are perspective views of the socket embodiments of FIGS. 2*a*-2*h* in engagement and disengagement with the spray head embodiments of FIGS. 5 and 5*a* and the bonnet embodiments of FIGS. 4 and 4*a;*
Figure 9B:
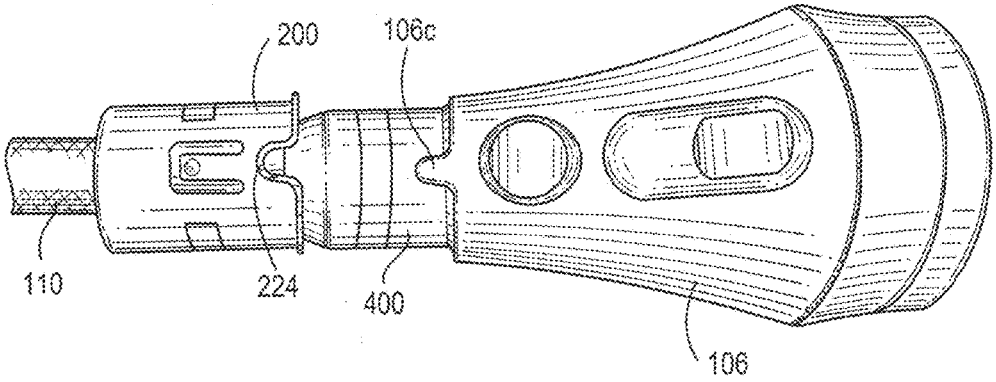
Figure 9D:
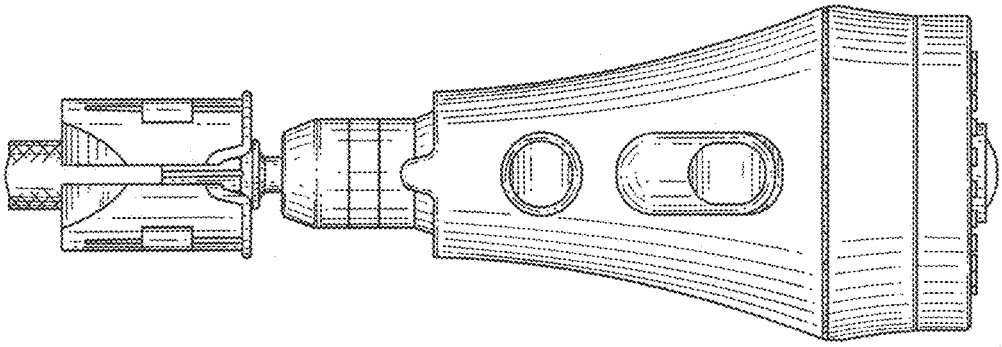
Figure 9C:
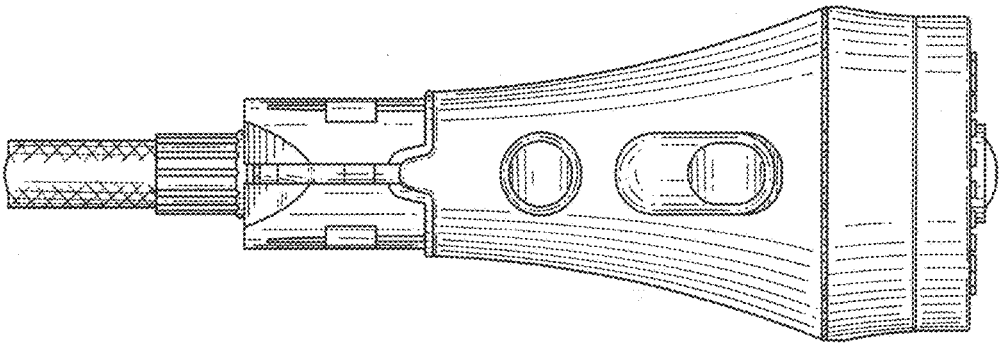
Figure 12A:
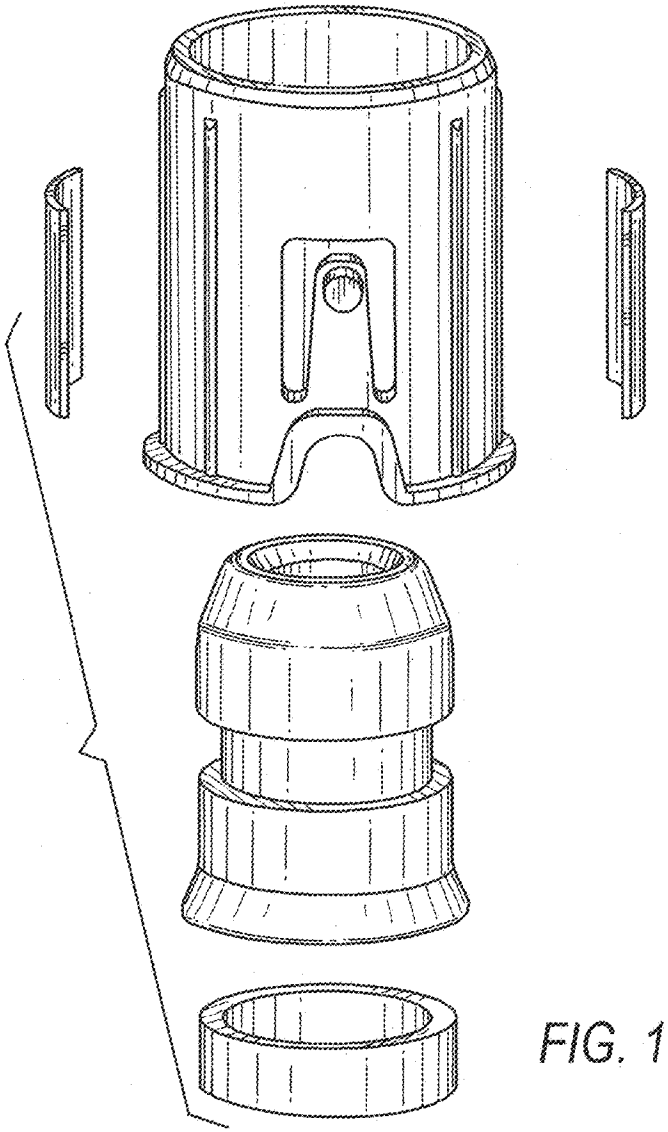
FIGS. 12, 12*a*, 13 and 13*a* are perspective, exploded, and cross-sectional views of the socket embodiments of FIGS. 10 and 10*a* in engagement with the bonnet embodiments of FIGS. 4 and 4*a;*
Figure 12:
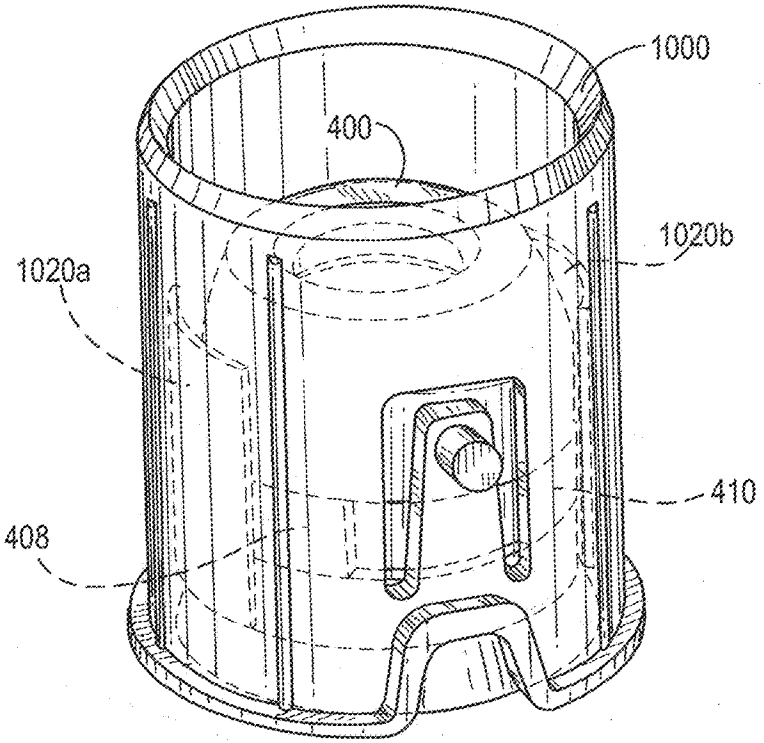
Figure 13A:
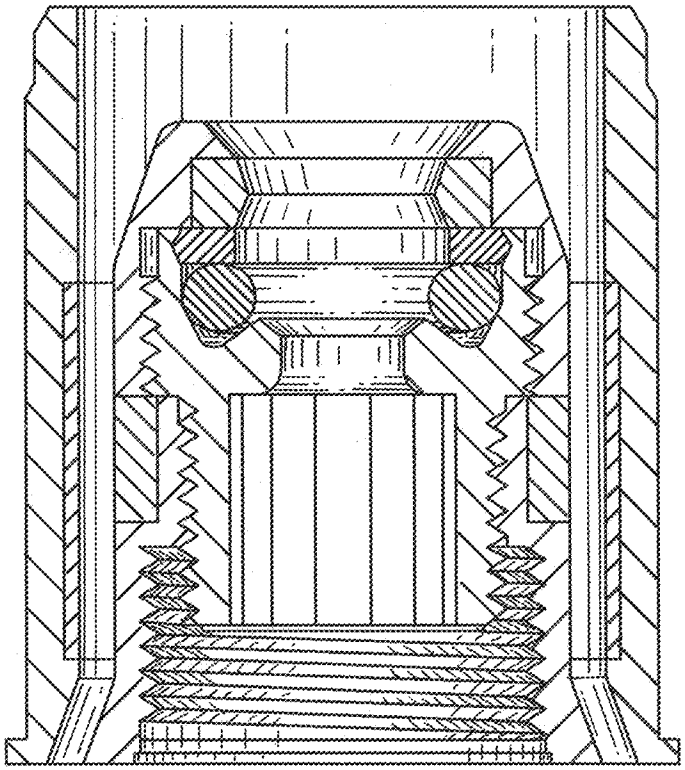
Figure 13:
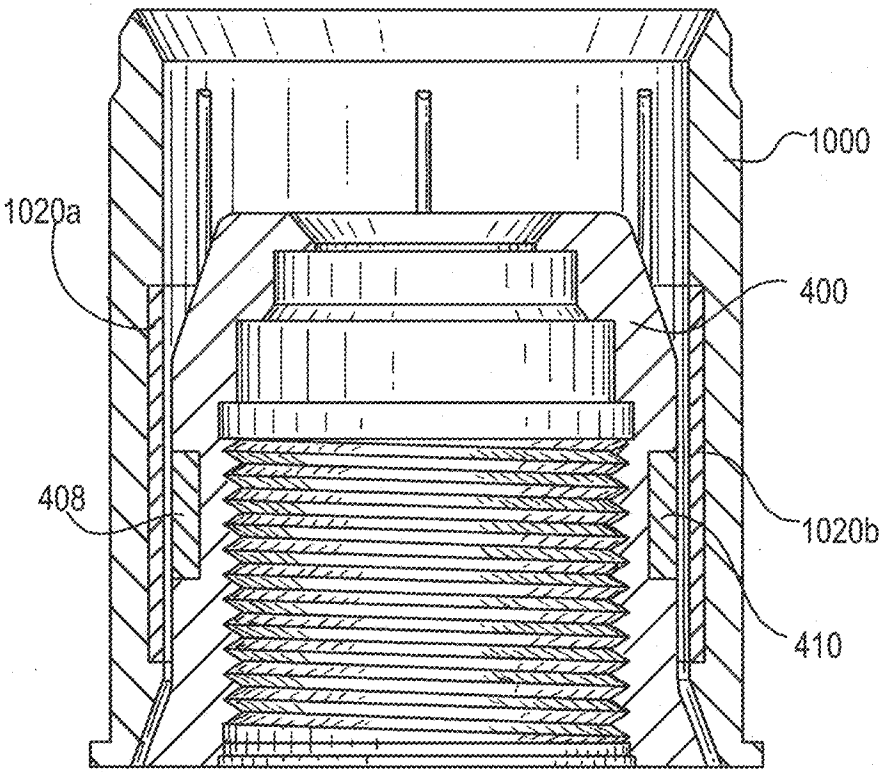

FIGS. 9*a*-9*d* are perspective views of the socket embodiments of FIGS. 2*a*-2*h* engaged and disengaged, respectively, with the spray head embodiments of FIGS. 5 and 5*a* and the bonnet embodiments of FIGS. 4 and 4*a*. As shown in FIGS. 9*a* and 9*b*, spray head 106 can also include an alignment feature 106*c* configured to interact with slot 224 of the socket. In some embodiments, alignment feature 106*c* and slot 224 may be complementarily tapered to correct initial misalignment between spray head 106 and socket 200. As spray head 106 and socket 200 are brought together, the tapered edges of alignment feature 106*c* and slot 224 can urge magnetic coupling elements 220*a* and 220*b* and magnetic coupling elements 408 and 410 into alignment to securely dock spray head 106 to spout 104.

As described above with respect to FIGS. 2*a*-2*d*, the socket of the magnetic docking system includes magnetic coupling elements 220*a* and 220*b* that are press fitted into or otherwise adhered in apertures 212 and 214 of shell 210. In some alternate embodiments, the socket does not include any such apertures, but instead includes magnetic coupling elements integrated into the shell.

FIGS. 10 and 10*a* are perspective views of a socket (1000, 1000'). Socket 1000 can include a shell 1010, a base portion 1011, a clip member 1030, a gap 1031, an engagement member 1032, and a slot 1024, all of which may be similar to corresponding elements of socket 200. However, rather than including apertures (e.g., apertures 212 and 214) and magnetic coupling elements (e.g., magnetic coupling elements 408 and 410) inserted into the apertures, socket 1000 can include magnetic coupling elements 1020*a* and 1020*b* integrated at least partially into shell 1010.

FIGS. 11 and 11*a* are perspective views of exemplary magnetic coupling elements. Magnetic coupling elements 1020*a* and 1020*b*, which can be composed of a permanent magnet or ferromagnetic material, such as iron, for example, can be substantially similar to one another in size, and can be integrated into the shell in any suitable manner (e.g., via insert molding). As shown in FIG. 10, magnetic coupling elements 1020*a* and 1020*b* may be disposed on opposite sides of shell 1010. Generally speaking, however, the specific arrangement of magnetic coupling elements 1020*a* and 1020*b* in shell 1010 can be selected such that the elements are situated proximate to, or otherwise align with, counterpart magnetic coupling elements of a bonnet (e.g., bonnet 400), when socket 1000 engages the bonnet. That is, magnetic coupling elements 1020*a* and 1020*b* may not be disposed directly opposite one another in or on the shell, so long as they are arranged to magnetically engage with counterpart magnetic coupling elements of the bonnet when socket 1000 engages the bonnet.

FIGS. 12, 12*a*, 13 and 13*a* are perspective, exploded, and cross-sectional views of the socket embodiments of FIGS. 10 and 10*a* in engagement with the bonnet embodiments of FIGS. 4 and 4*a*.

Figure 14:
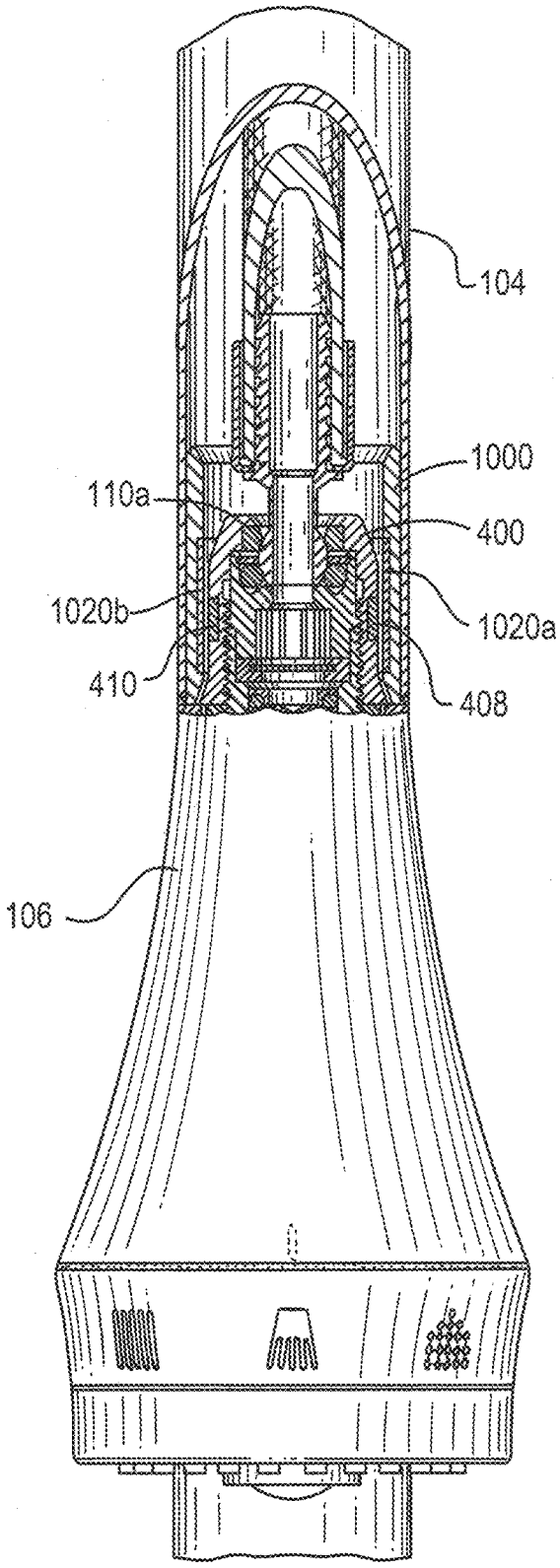
FIGS. 14 and 14*a* are cross-sectional views of spout ends having the socket embodiments of FIGS. 10 and 10*a* inserted therein and having the spray head embodiments of FIGS. 5 and 5*a* docked thereto.
Figure 14A:
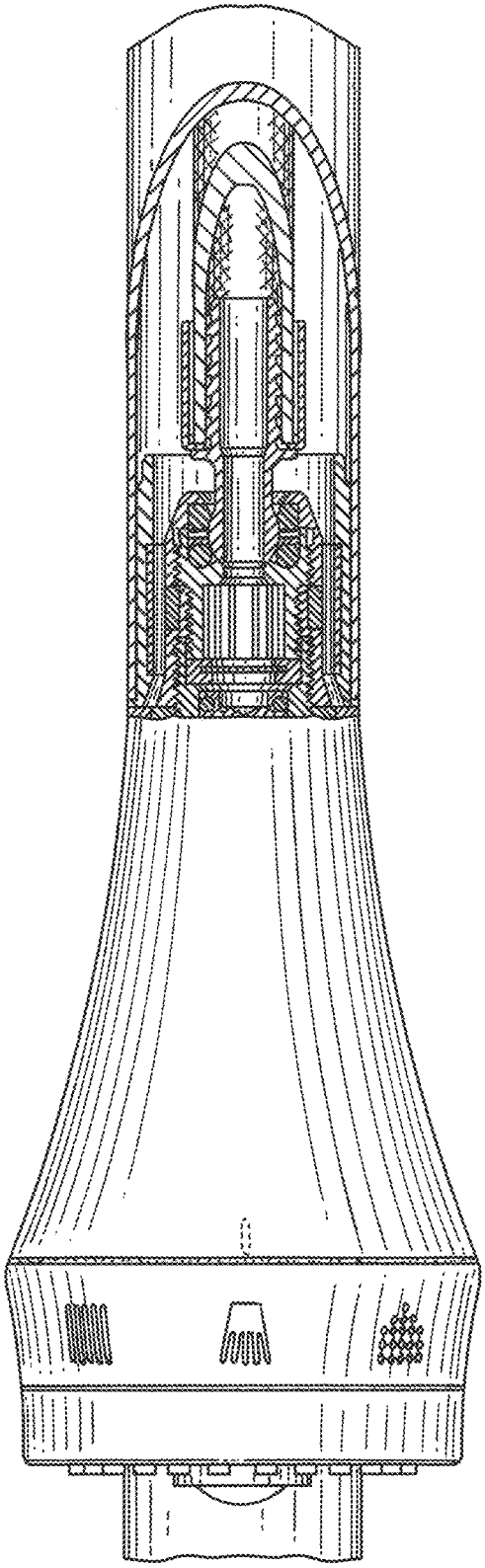

FIGS. 14 and 14*a* are cross-sectional views of spout ends having the socket embodiments of FIGS. 10 and 10*a* inserted therein and having the spray head embodiments of FIGS. 5 and 5*a* docked thereto.

Figure 15A:
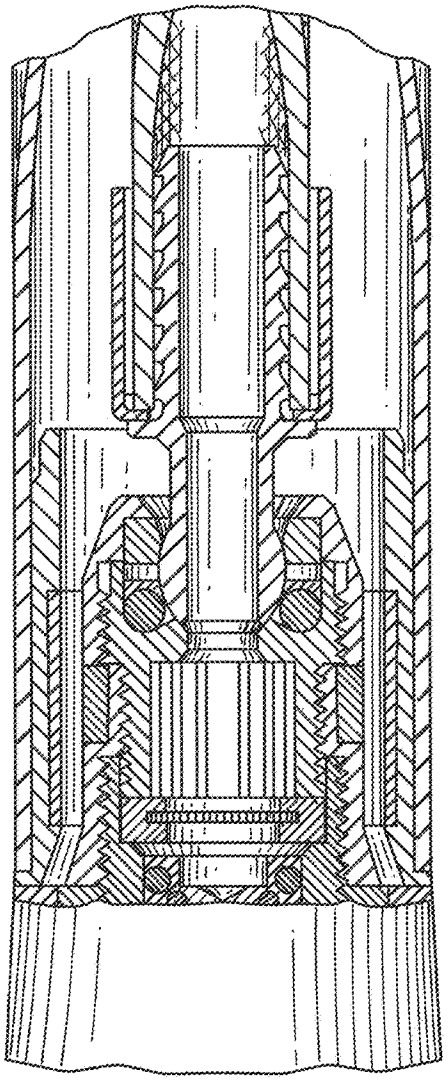
FIGS. 15 and 15*a* are detailed cross-sectional views of the socket embodiments of FIGS. 10 and 10*a* in engagement with the bonnet embodiments of FIGS. 4 and 4*a;*
Figure 15:
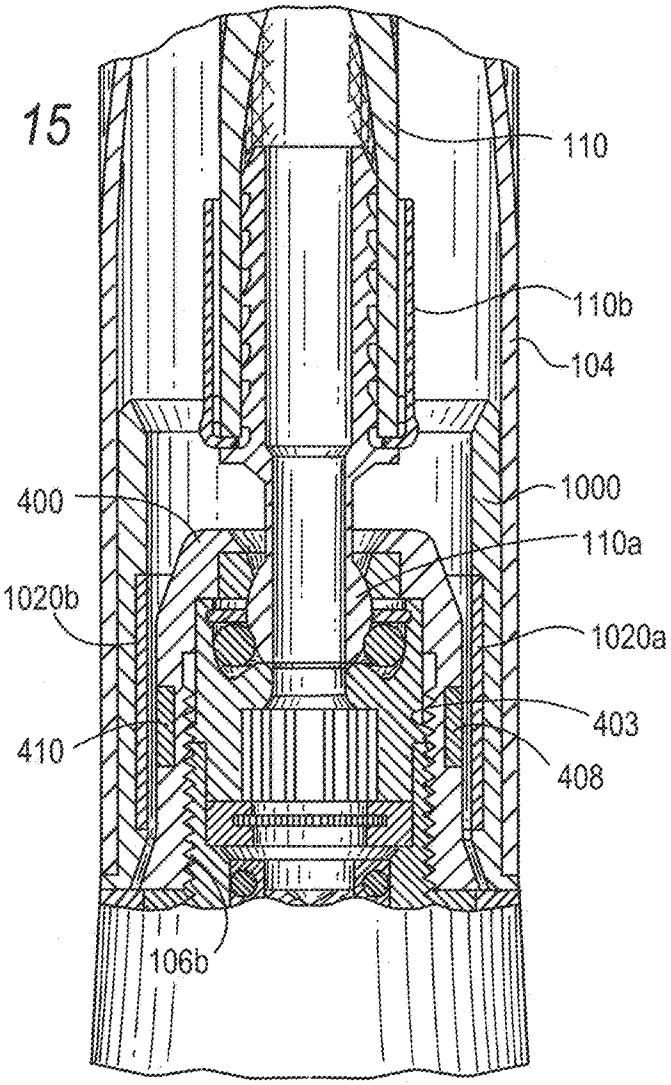

FIGS. 15 and 15*a* are detailed cross-sectional views of the socket embodiments of FIGS. 10 and 10*a* in engagement with the bonnet embodiments of FIGS. 4 and 4*a*. In particular, FIG. 15 shows the interaction between magnetic coupling elements 1020*a* and 1020*b* of socket 1000 and magnetic coupling elements 408 and 410 of bonnet 400.

Figure 16:
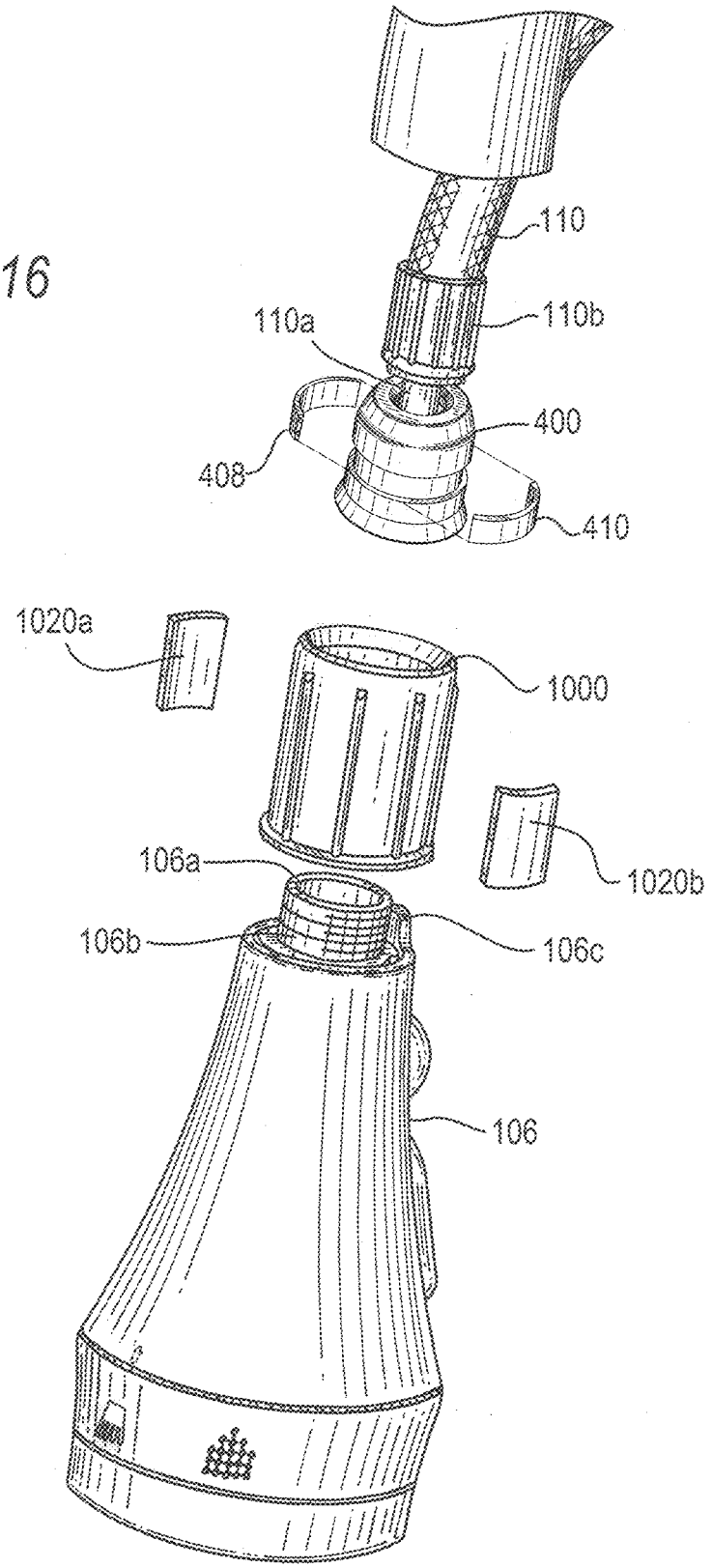
FIGS. 16 and 16*a* are exploded views of the spray head embodiments of FIGS. 5 and 5*a*, the socket embodiments of FIGS. 10 and 10*a*, the bonnet embodiments of FIGS. 4 and 4*a*, and the hose embodiments of FIGS. 6*a*-6*d;*
Figure 16A:
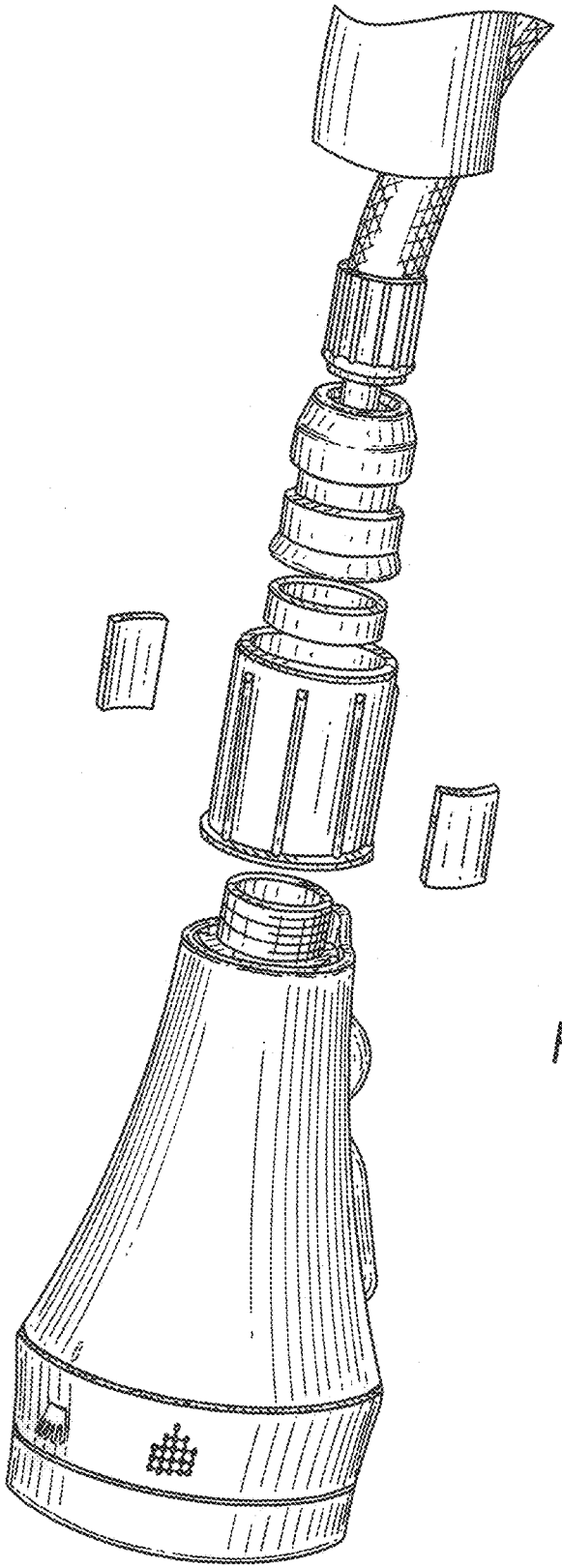

FIGS. 16 and 16*a* are exploded views of the spray head embodiments of FIGS. 5 and 5*a*, the socket embodiments of FIGS. 10 and 10*a*, the bonnet embodiments of FIGS. 4 and 4*a*, and the hose embodiments of FIGS. 6*a*-6*d*.

As shown in FIGS. 12, 13, 14, and 15, magnetic coupling elements 408 and 410 can be respectively situated proximate to, or otherwise aligned with, magnetic coupling elements 1020*a* and 1020*b* such that their corresponding magnetic attractions detachably retain spray head 106 in its docked position. It is to be understood that the shapes and sizes of the magnetic engagement elements may vary according to the shape of spout 104, spray head 106, and/or socket 1000, and thus, magnetic coupling elements 1020*a* and 1020*b* may or may not fully overlap magnetic coupling elements 408 and 410 in all directions when socket 1000 is engaged with bonnet 400.

As described above with respect to FIG. 4, bonnet 400 (including base 402, neck 406, and cap 404) may be constructed as a single component. For example, bonnet 400 can be machined into its bell-shaped construction, and neck 406 can be machined to form groove 407. Bonnet 400 can alternatively be constructed from multiple components. For example, base 402, neck 406, and cap 404 can be separate components joined to one another (e.g., via adhesive or threaded connections). In other embodiments, base 402 and neck 406 constitute a single component that is coupled to cap 404 to form bonnet 400. In further embodiments, cap 404 and neck 406 constitute a single component that is coupled to a base 402 to form bonnet 400.

Figure 17A:
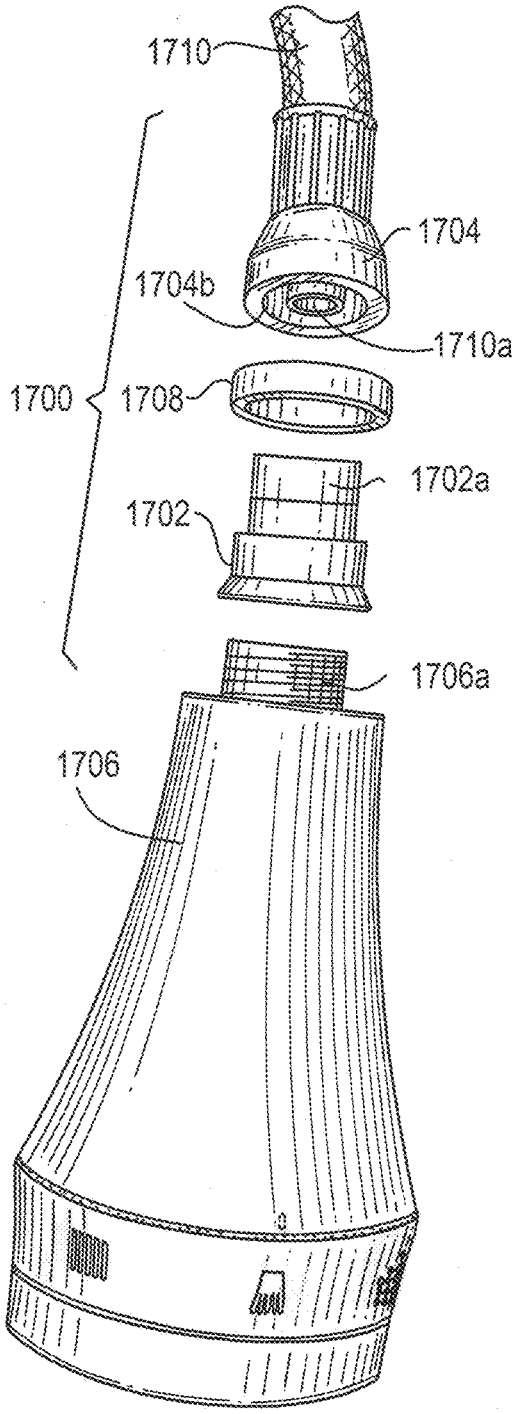

In some embodiments, the bonnet may be constructed from separate components of a spray head and hose that are coupled to one another. FIGS. 17*a* and 17*c* are disassembled perspective views of embodiments of a bonnet (1700, 1700'). As shown in FIG. 17*a*, bonnet 1700 can be constructed from a base 1702, which can be coupled to a spray head 1706, a cap 1704, and a magnetic coupling element 1708 sandwiched between base 1702 and cap 1704. Spray head 1706 can include, or be otherwise coupled to, a male threaded connector 1706*a* for coupling to a corresponding threaded bore at a first end of base 1702. Base 1702 can include a male threaded connector 1702*a* for coupling to a corresponding threaded bore 1704*b* of cap 1704. Male threaded connector 1702*a* can be formed at a second end of base 1702 having a smaller radius than the first end. Magnetic coupling element 1708, which can be a ring-shaped permanent magnet, for example, and can be provided annularly around the second end of base 1702 and trapped between cap 1704 and the second end of base 1702 when the cap and base are coupled together.

Figure 17B:
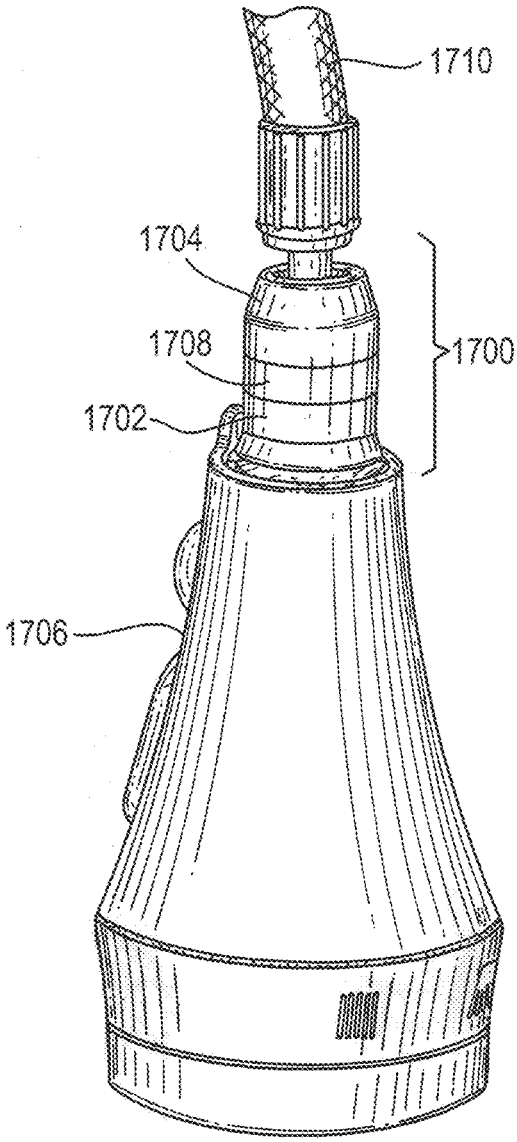
Figure 18A:
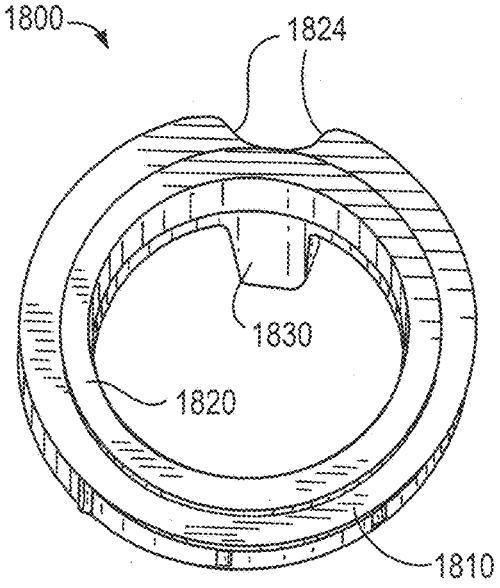
FIGS. 18*a*-18*d* are perspective views of exemplary embodiments of a socket.
Figure 18B:
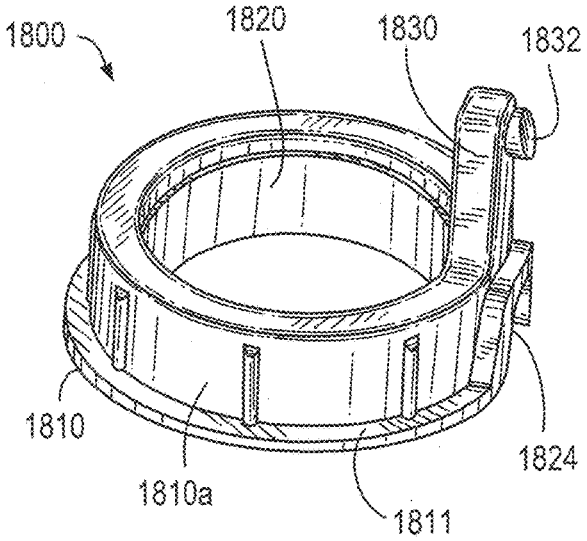
Figure 18C:
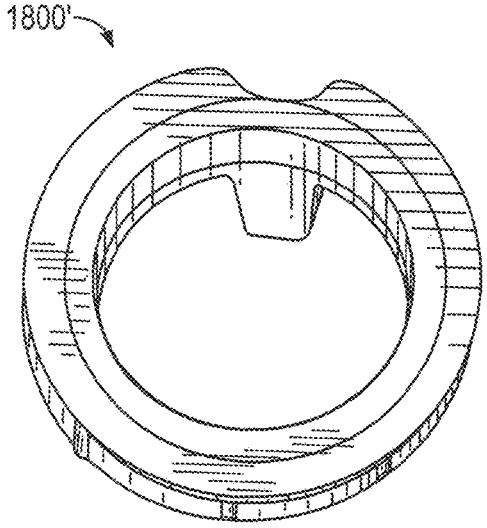
Figure 18D:
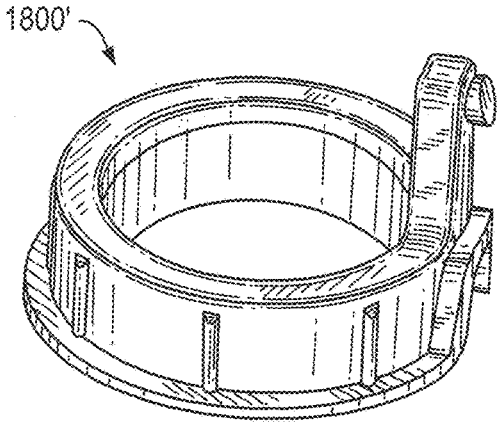
Figure 19A:
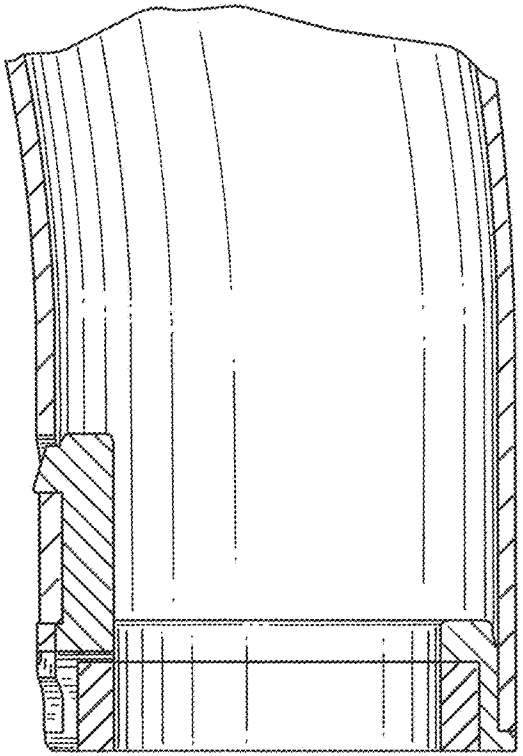
FIGS. 19, 19*a*, 20, and 20*a* are cross-sectional and perspective views of spout ends having the socket embodiments of FIGS. 18*a*-18*d* inserted therein.
Figure 19:
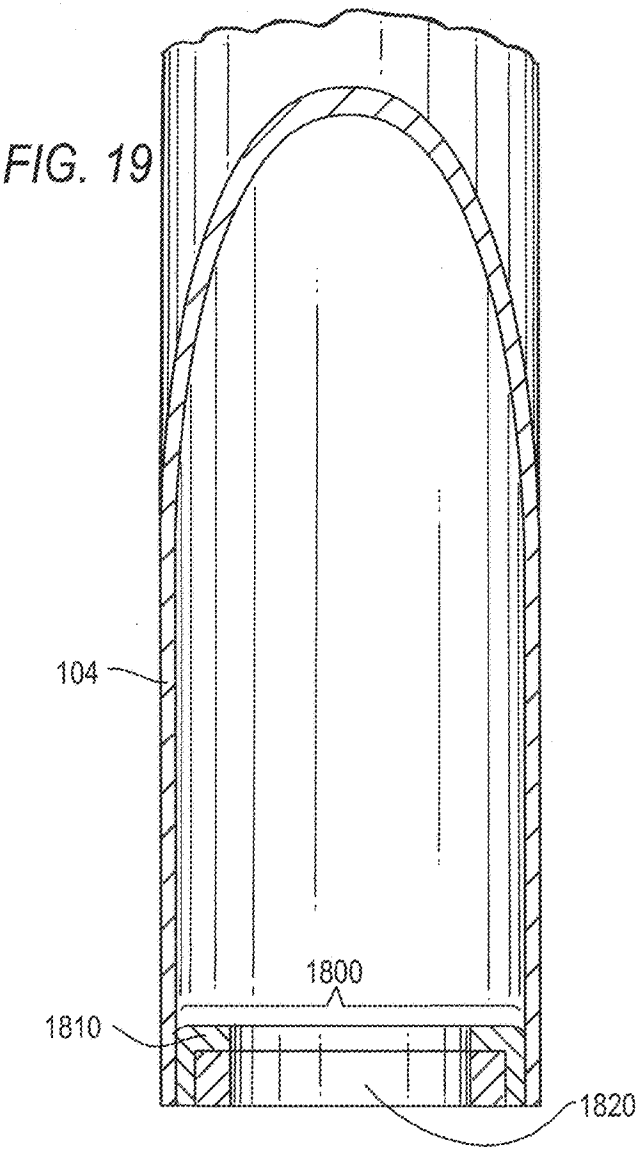
Figure 20A:
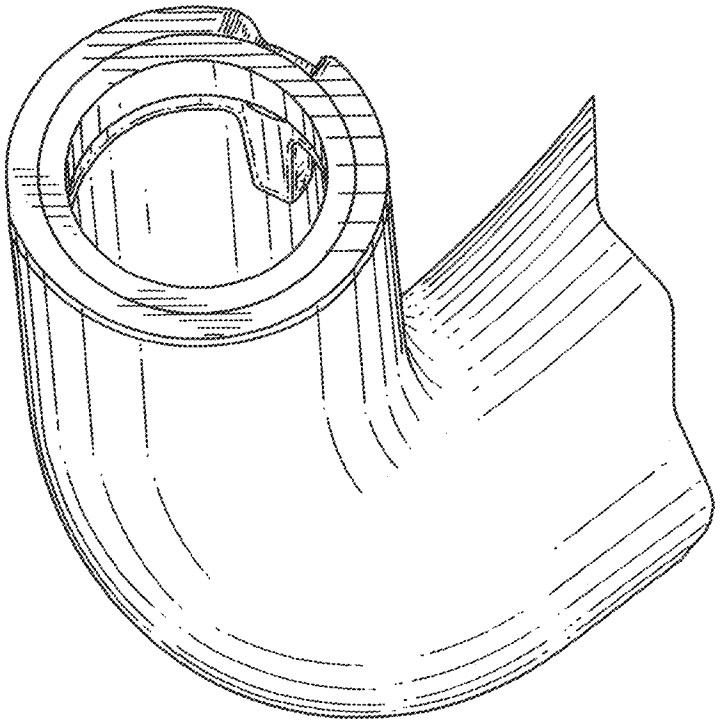
Figure 20:
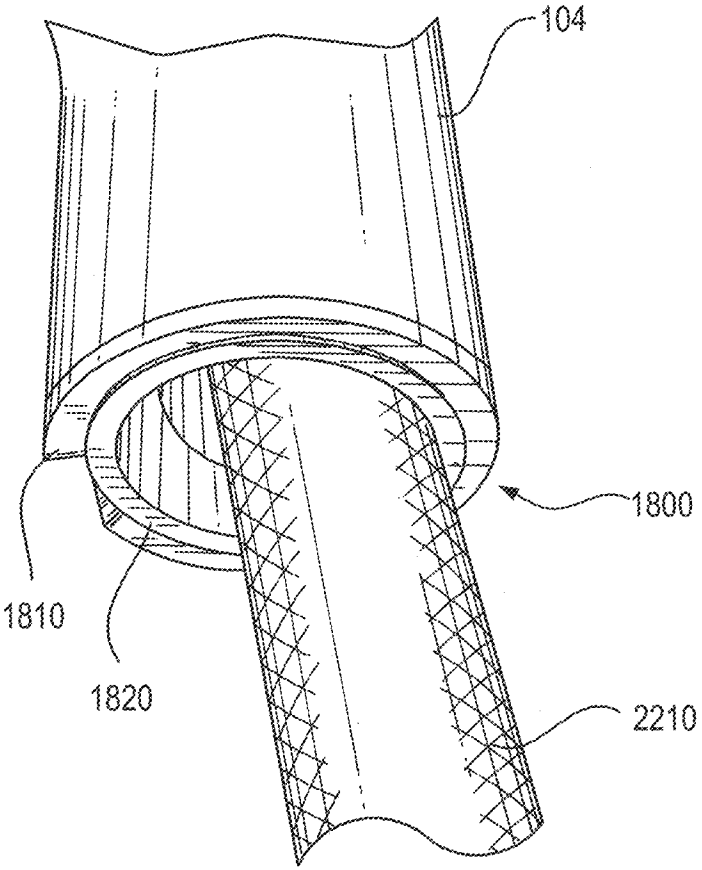

FIGS. 17*b* and 17*d* are assembled perspective views of the bonnet embodiments of FIGS. 17*a* and 17*c*. As shown in FIG. 17*b*, spray head 1706 can be coupled to hose 1710 via bonnet 1700 with magnetic coupling 1708 trapped between base 1702 and cap 1704. Cap 1704 may be coupled to a crimped ball joint 1710*a* of a hose 1710 (that may be similar to crimped ball joint 110*a* of hose 110) to form a swiveling ball-and-socket joint between hose 1710 and spray head 1706.

As described above, embodiments of a magnetic docking system can include a socket and bonnet, each provided with corresponding magnetic coupling elements aligned in a concentric configuration in a docked position of the spray head. In other embodiments, however, a magnetic docking system can include a different socket configuration and corresponding spray head connection mechanism. FIGS. 18*a*-18*d* are perspective views of a socket (1800, 1800'). Socket 1800 can include a bracket 1810 and an annular magnetic coupling element 1820 disposed within the inner circumference of the bracket and fixed thereto (e.g., via press fitting and/or other adhesive mechanism). Annular magnetic coupling element 1820 can be composed of any suitable magnetic or ferromagnetic material capable of magnetically coupling to a corresponding magnetic coupling element as described below. Bracket 1810 can be composed of plastic or any other suitable material and can be shaped to conform to the inner surface of an end of a spout, such as spout 104, for example. Similar to shell 210 and shell 1010, bracket 1810 may include a base portion 1811 having a circumference larger than the circumference of outer surface 1810*a* of the bracket. In some embodiments, the circumference of base portion 1811 may be larger than the circumference of the inner surface of the spout and may be substantially equal to the circumference of the outer surface of the spout. Accordingly, base portion 1811 can function as a stopping mechanism during insertion of socket 1800 into the spout. Additionally, bracket 1810 can include a slot 1824 (similar to slot 224), and can also include a clip member 1830 (similar to clip member 230 and clip member 1030) as well as an engagement member 1832 (similar to engagement member 232 and engagement member 1032) for retaining socket 1800 in the spout. FIGS. 19, 19*a*, 20, and 20*a* are cross-sectional and perspective views of spout ends having the socket embodiments of FIGS. 18*a*-18*d* inserted therein.

Figure 21B:
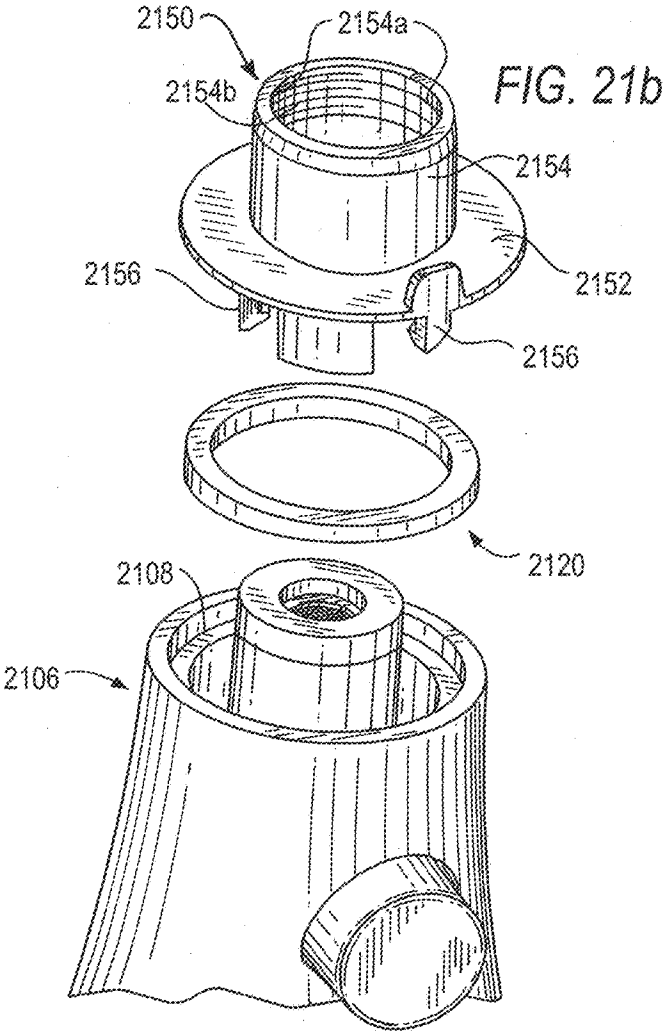
FIGS. 21*a*-21*d* are perspective and exploded views of exemplary embodiments of a spray head.
Figure 21A:
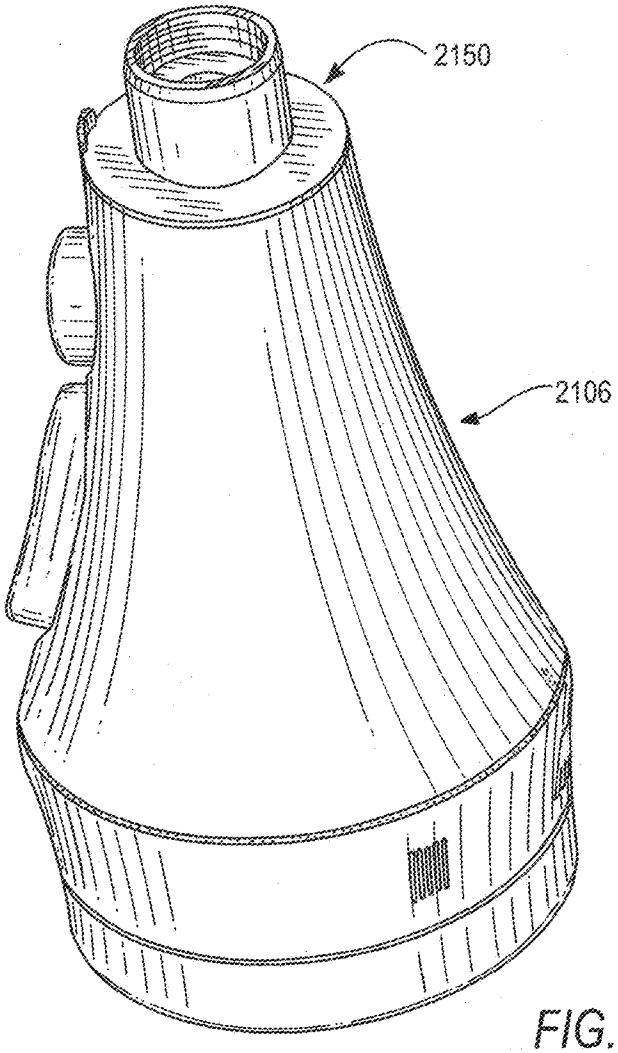
Figure 21D:
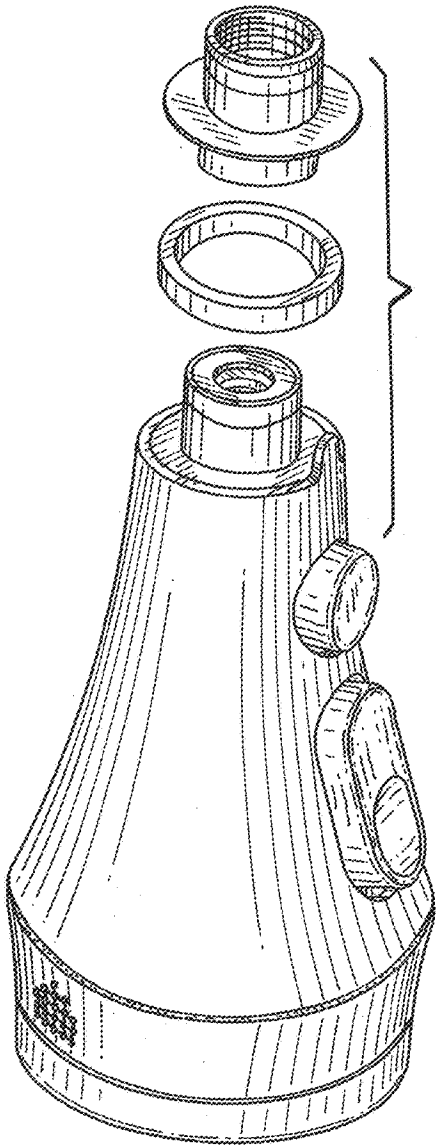
Figure 21C:
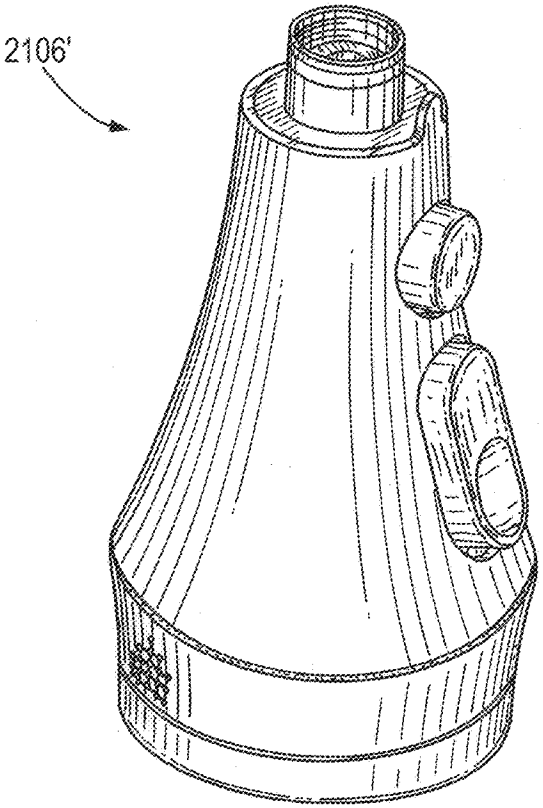

As a counterpart to socket 1800, the magnetic docking system may also include an adaptor 2150 and an annular magnetic coupling element coupled to a spray head. FIGS. 21*a*-21*d* are perspective and exploded views of embodiments of a spray head (2106, 2106'), which can be similar to spray head 106. As shown in FIG. 21*a*, annular magnetic coupling element 2120 can be sandwiched between the base of spray head 2106 and adaptor 2150. Spray head 2106 can include a recess 2108 to retain annular magnetic coupling element 2120. Adaptor 2150 can include a platform 2152, a tube 2154 disposed on one side of the platform, and latches 2156 disposed on a side of the platform opposite tube 2154. Latches 2156 are configured to interact with a latch receiving feature (e.g., via a snap fit) within the body of spray head 2106 (described in more detail below) to attach adaptor 2150 to spray head 2106. An opening 2154*a* of tube 2154 includes threads 2154*b* and functions as a female connector for coupling to a corresponding male connector of a hose.

Figure 22:
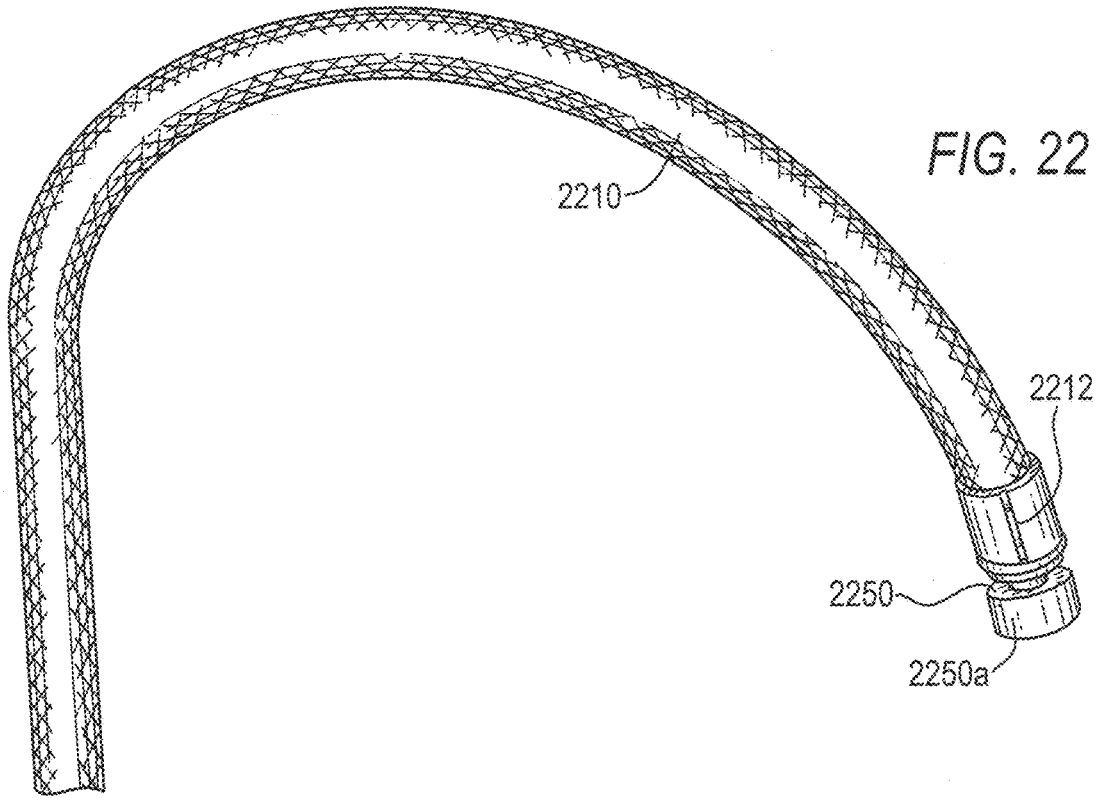
FIGS. 22 and 22*a* are perspective views of exemplary embodiments of a hose.
Figure 22A:
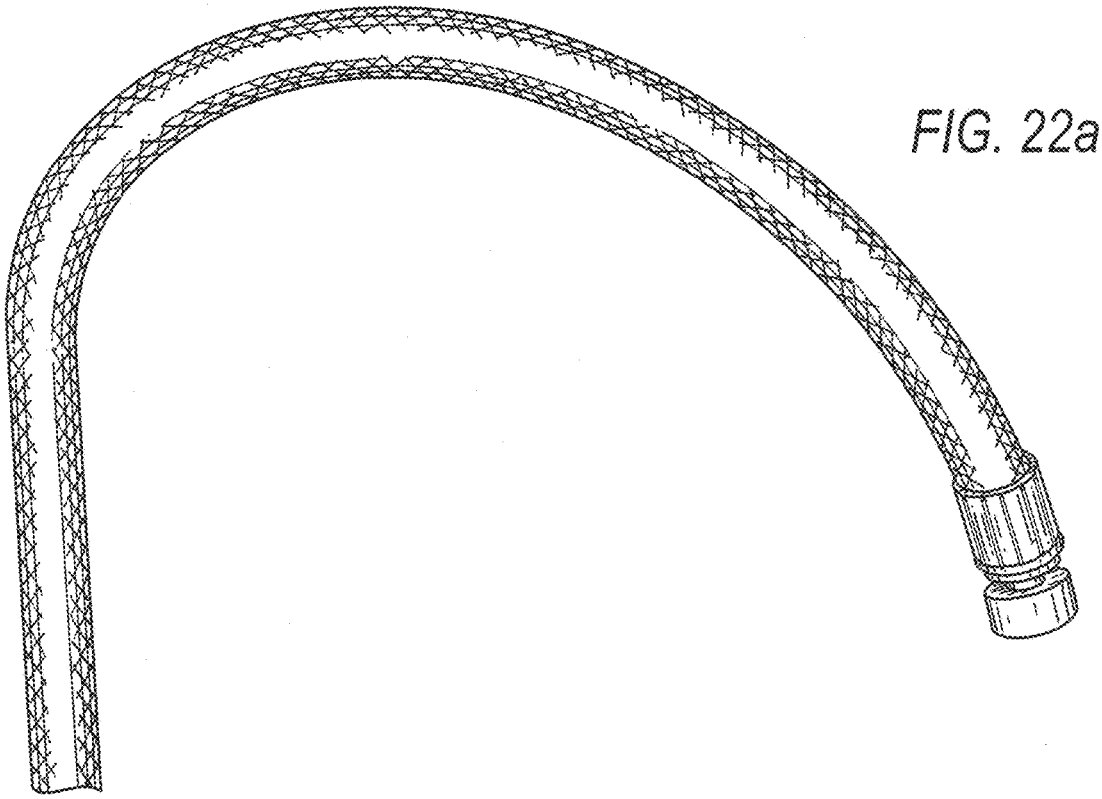

FIGS. 22 and 22*a* are perspective views of embodiments of a hose (2210, 2210'). Hose 2210 can, for example, be similar to hose 110. Instead of including a ball joint, such as crimped ball joint 110*a*, however, hose 2210 can include a male connector 2250 coupled to an end 2212 of hose 2210, having threads 2250*a* for coupling to the threads 2154*b* of adaptor 2150.

Figure 23A:
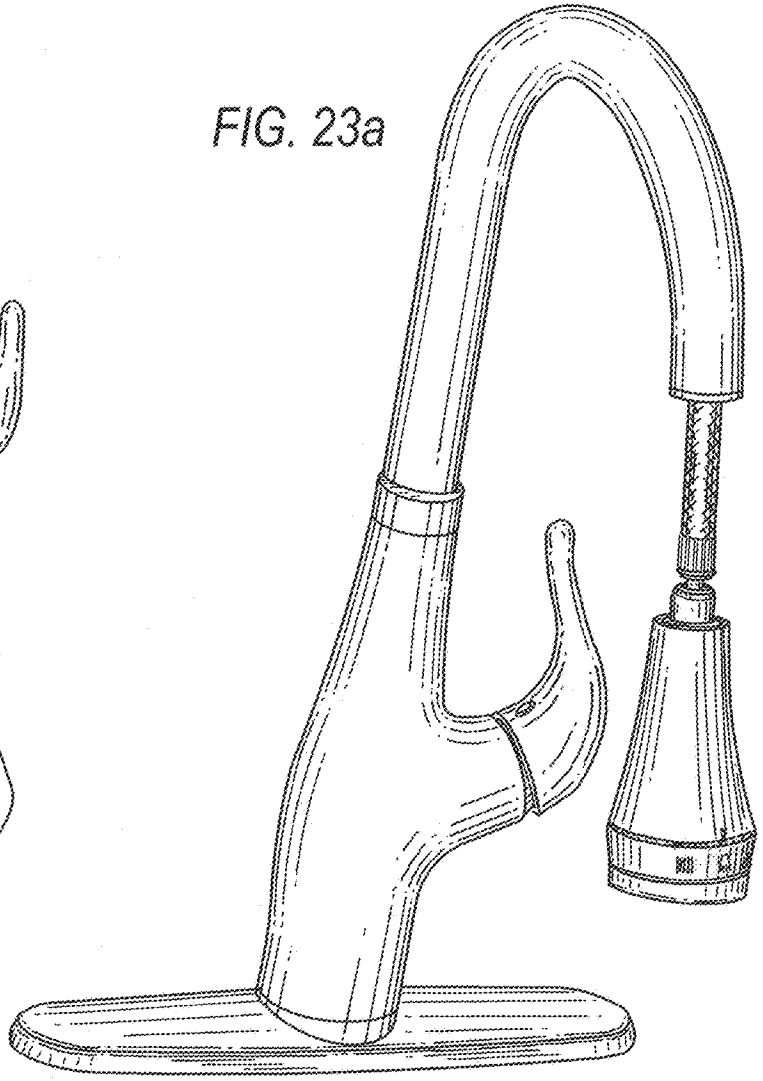
FIGS. 23 and 23*a* are perspective views of the hose embodiments of FIGS. 22 and 22*a* and the spray head embodiments of FIGS. 21*a*-21*d,* illustrating the hose embodiments disposed through faucet spouts and coupled to the spray head embodiments.
Figure 23:
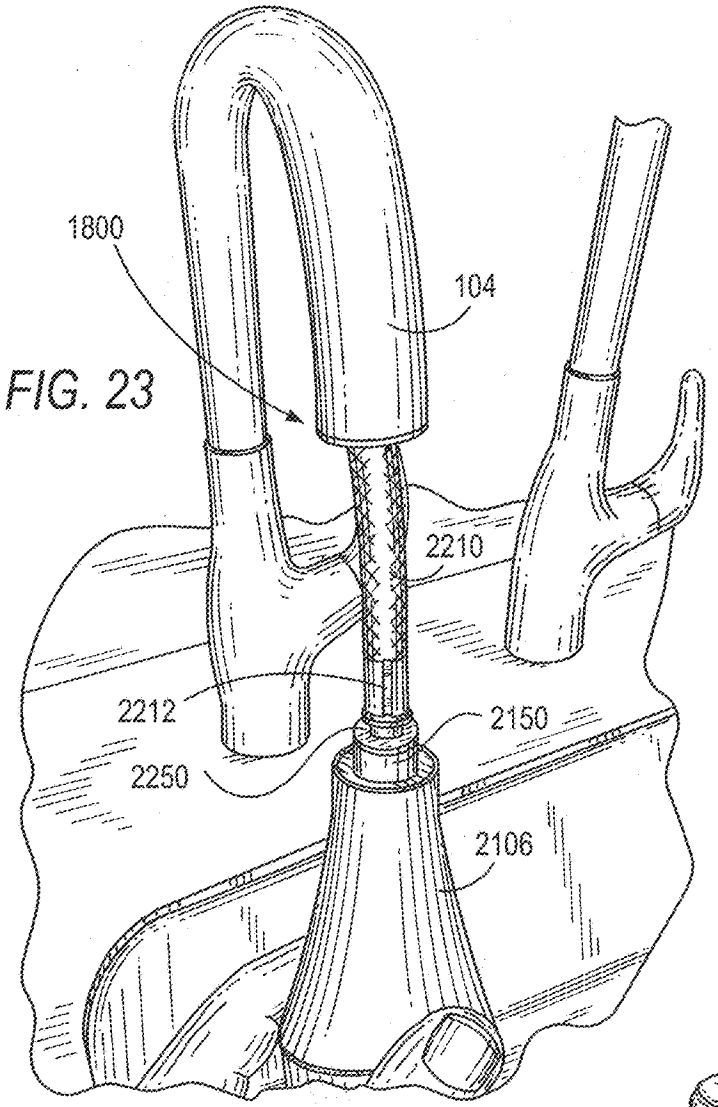

FIGS. 23 and 23*a* are perspective views of the hose embodiments of FIGS. 22 and 22*a* and the spray head embodiments of FIGS. 21*a*-21*d*, illustrating the hose embodiments disposed through faucet spouts and coupled to the spray head embodiments. As shown in FIG. 23, hose 2210 can be disposed through spout 104 of faucet 100 and spray head 2106 coupled to hose 2210 in an undocked position.

Figure 24:
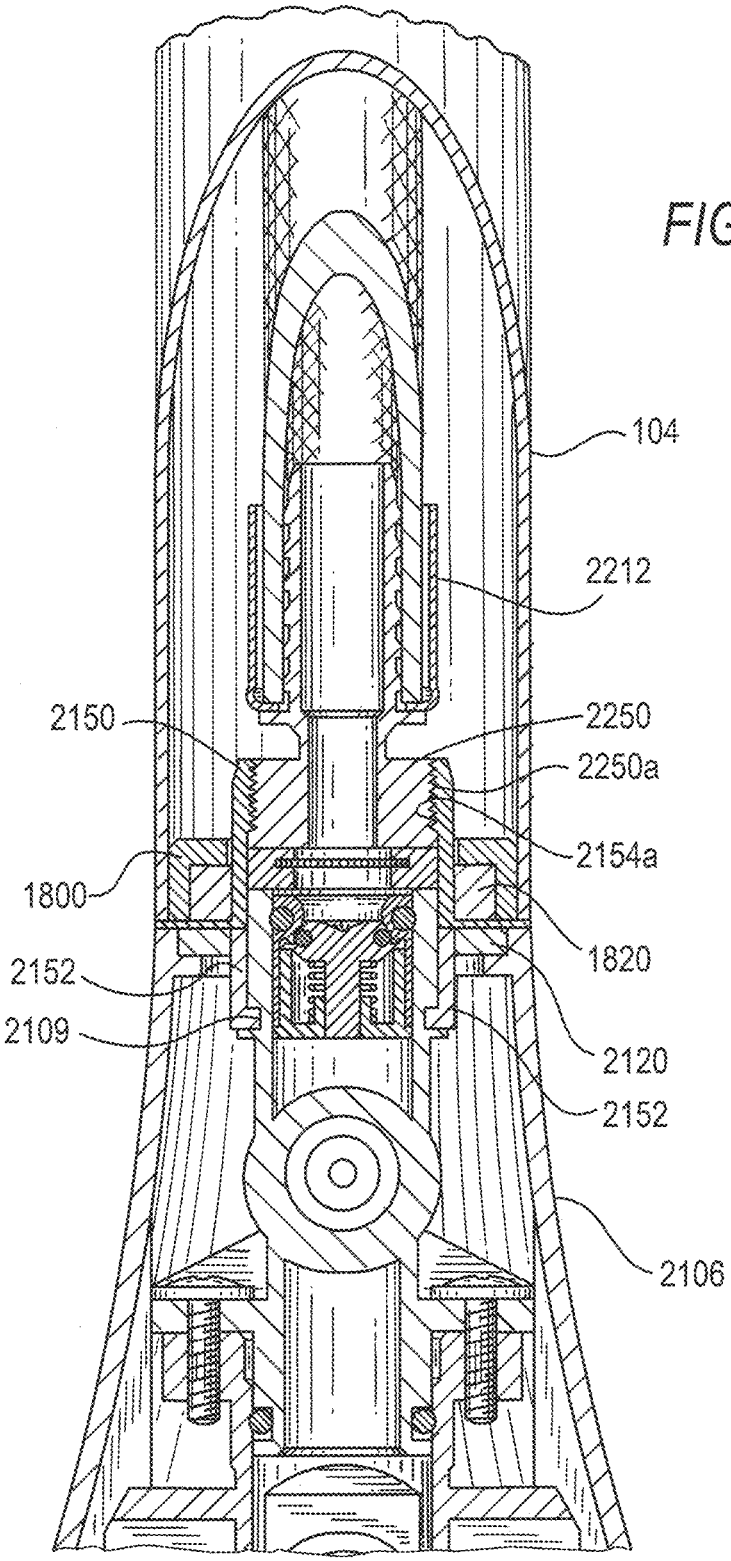
FIGS. 24 and 24*a* are a cross-sectional views of the spray head embodiments of FIGS. 21*a*-21*d* in docked positions.
Figure 24A:
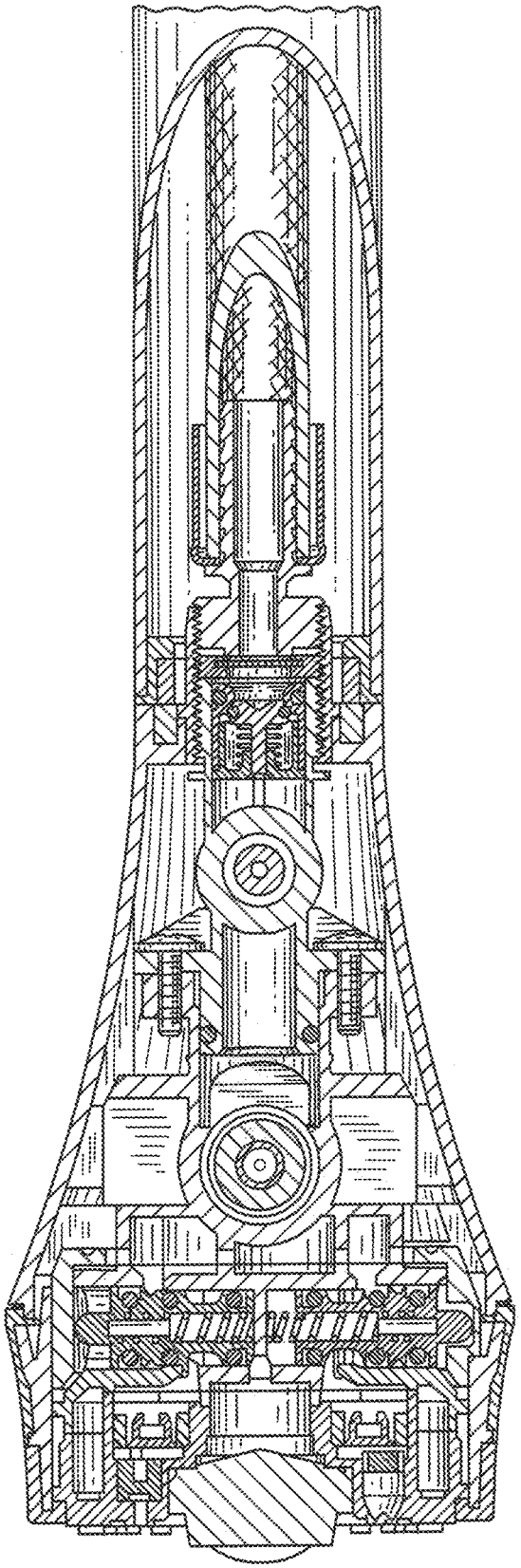

FIGS. 24 and 24*a* are cross-sectional views of the spray head embodiments of FIGS. 21*a*-21*d* in docked positions. As shown in FIG. 24, male connector 2250 can extend through end 2212 into hose 2210 and can be coupled to threads 2154*b* of adaptor 2150 via threads 2250*a*. Latches 2156 of adaptor 2150 may be coupled to latch receiving feature 2109 (e.g., a recess) within the spray head such that adaptor 2150 snap fits into spray head 2106. Furthermore, annular magnetic coupling element 2120 may be magnetically attracted to annular magnetic coupling element 1820 to retain spray head 2106 in its docked position relative to spout 104.

Figure 25:
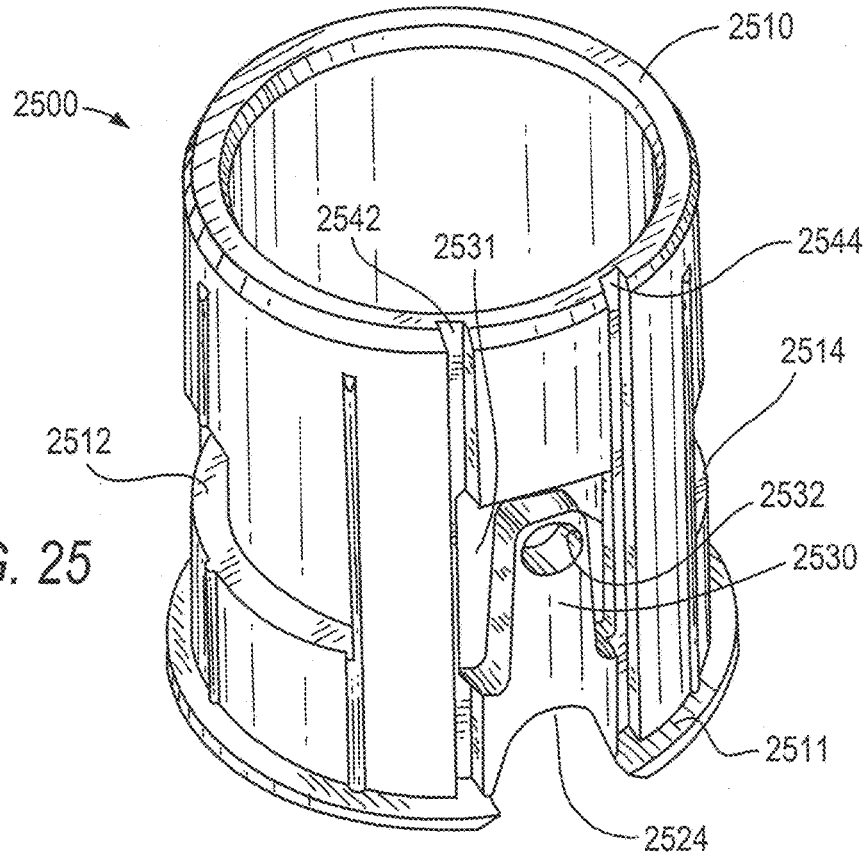
FIG. 25 is a disassembled perspective view of an alternate socket, in accordance with an embodiment of the present invention.
Figure 26:
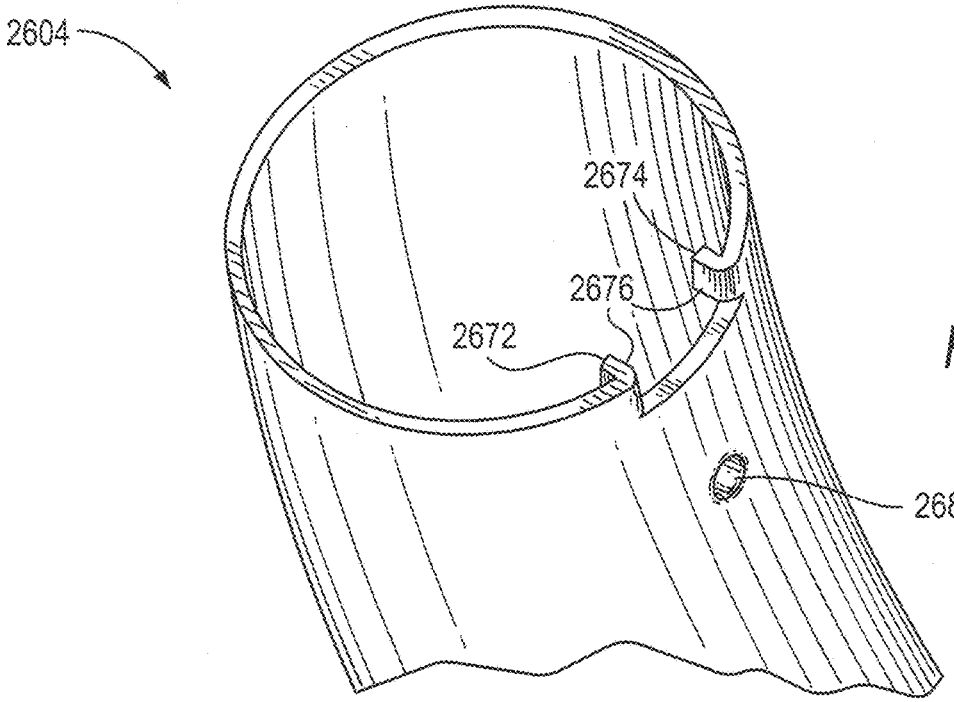
FIG. 26 is a partial bottom perspective view of an alternate faucet spout, in accordance with an embodiment of the present invention.
Figure 27:
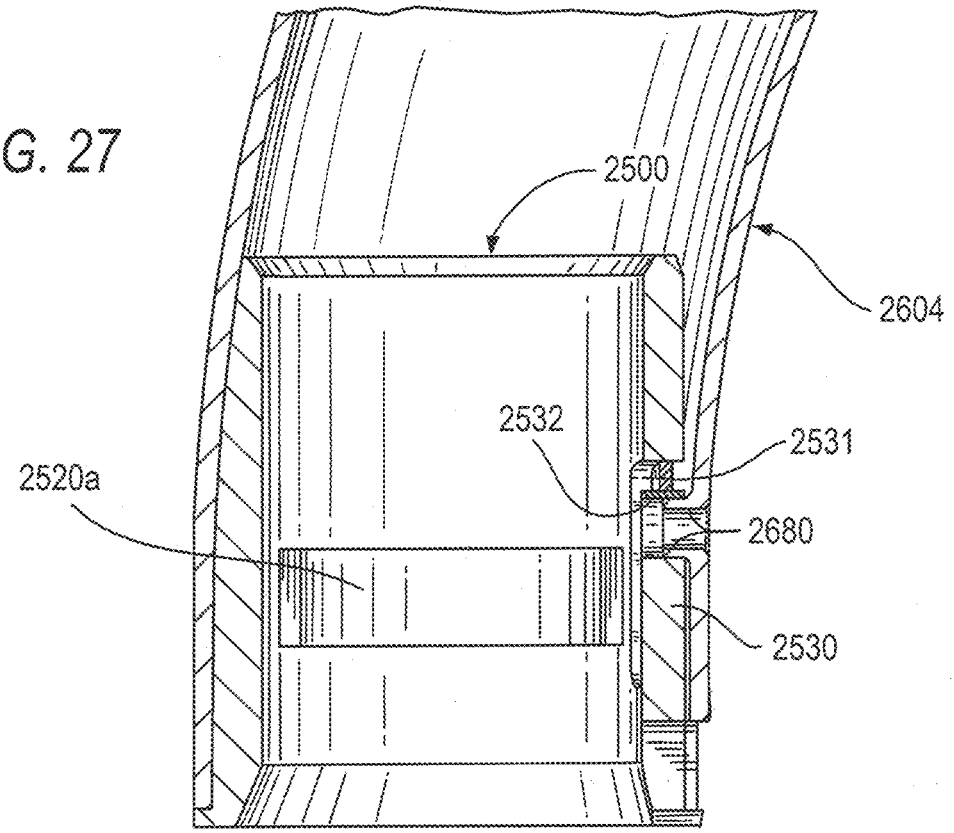
FIGS. 27 and 28 are cross-sectional and bottom perspective views of the spout of FIG. 26 having the socket of FIG. 25 inserted therein, in accordance with an embodiment of the present invention.
Figure 28:
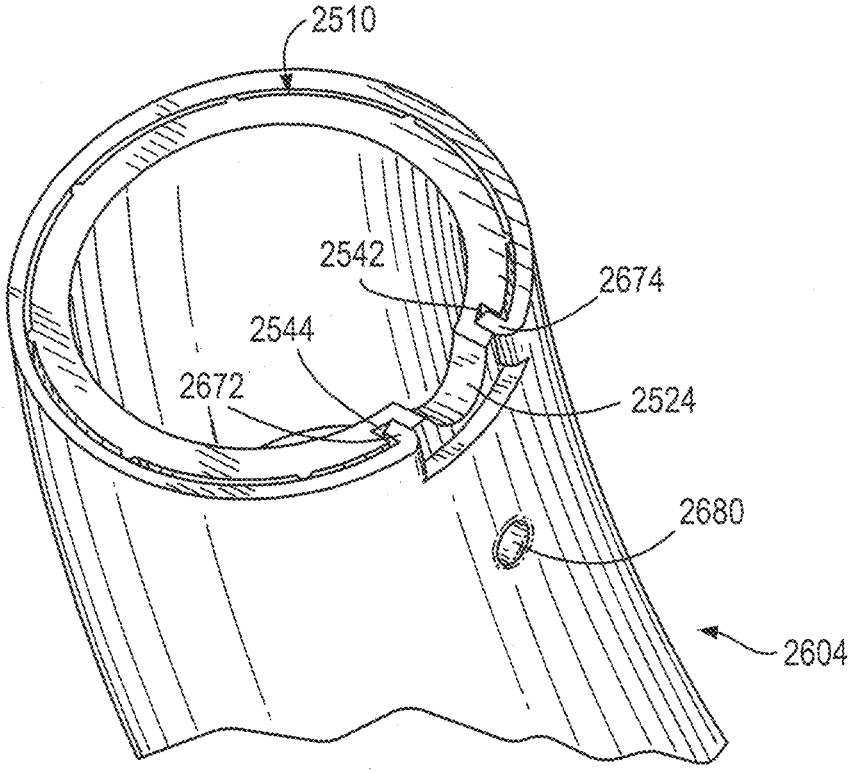

FIG. 25 is a disassembled perspective view of an alternate socket 2500 of a magnetic docking system, in accordance with an embodiment of the present invention. FIG. 26 is a partial bottom perspective view of a faucet spout 2604. FIGS. 27 and 28 are cross-sectional and bottom perspective views of spout 2604 having socket 2500 inserted therein.

Socket 2500 may be similar to socket 200 of FIGS. 2*a*-2*d*, and includes a shell 2510, a base portion 2511, a clip member 2530, a gap 2531, and a slot 2524, all of which may be similar to corresponding elements of socket 200. However, rather than including a protruding engagement member (such as engagement member 232) on the clip member, clip member 2530 includes a through-hole 2532 (e.g., a female connector) defined to receive a complementary feature (e.g., a male connector) of spout 2604. Socket 2500 also includes channels 2542 and 2544 that span from base 2511 to the opposite end of shell 2510 and that are each defined to slidably receive alignment features of spout 2604. Socket 2500 additionally includes grooves 2512 and 2514 for retaining magnetic coupling elements. One of these magnetic coupling elements—magnetic coupling element 2520*a*—is shown in FIG. 27. As with magnetic coupling elements 220*a* and 220*b* of socket 200, the magnetic coupling elements of socket 2500 may be respectively coupled to grooves 2512 and 2514 using any suitable method, including, for example, incorporating the magnetic coupling elements into socket 2500 during an insert molding process or press-fitting, or otherwise adhering the magnetic coupling elements to socket 2500 after socket 2500 is formed. It is to be understood that socket 2500 can alternatively include apertures (e.g., similar to apertures 212 and 214) for retaining the magnetic coupling elements.

Spout 2604 includes sidewalls or alignment members 2672 and 2674 formed at the end of the spout and a gap 2676 disposed therebetween. Alignment members 2672 and 2674 can be formed in any suitable manner, including, for example, by providing a cut out portion on the spout end, and uncut portions with edges bent inwardly toward the opposite side of the spout end. Spout 2604 also includes an engagement member 2680 (e.g., a male connector) disposed proximate alignment members 2672 and 2674 that protrudes towards the center of the spout passageway. Engagement member 2680 can be formed in any suitable manner, including, for example, by stamping, punching, depressing, or drilling the spout such that portions of the spout in the periphery of the stamped, punched, depressed, or drilled area are directed towards the center of the spout passageway. In various embodiments, engagement member 2680 can also have a hole defined at its far end in the spout passageway. Alignment members 2672 and 2674 prevent socket 2500 from being inserted into the spout end in any orientation other than that shown in FIGS. 27 and 28 (i.e., where slot or channel 2544 aligns with and slidably receives alignment member 2672 and slot or channel 2542 aligns with and slidably receives alignment member 2674. When socket 2500 is fully inserted in the spout end, alignment members 2672 and 2674 are retained in respective portions of channels 2542 and 2544 proximate base 2511 of the socket, and engagement member 2680 is coupled to through-hole 2532 of clip member 2530 (e.g., as a male-to-female connection from the spout to the socket), securing socket 2500 in spout 2604.

Figure 29:
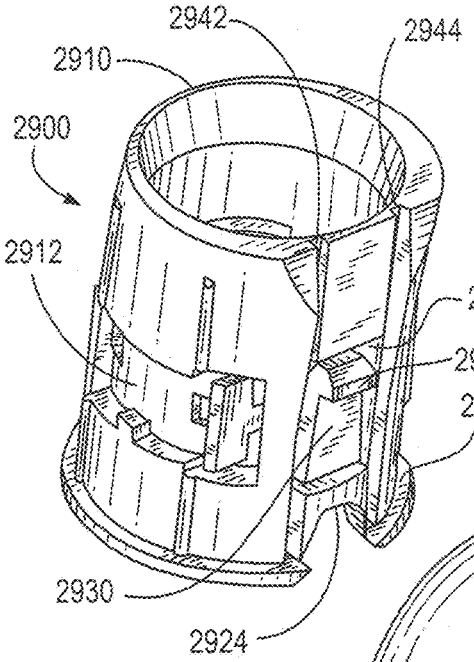
FIG. 29 is a disassembled perspective view of an alternate socket, in accordance with an embodiment of the present invention.
Figure 30:
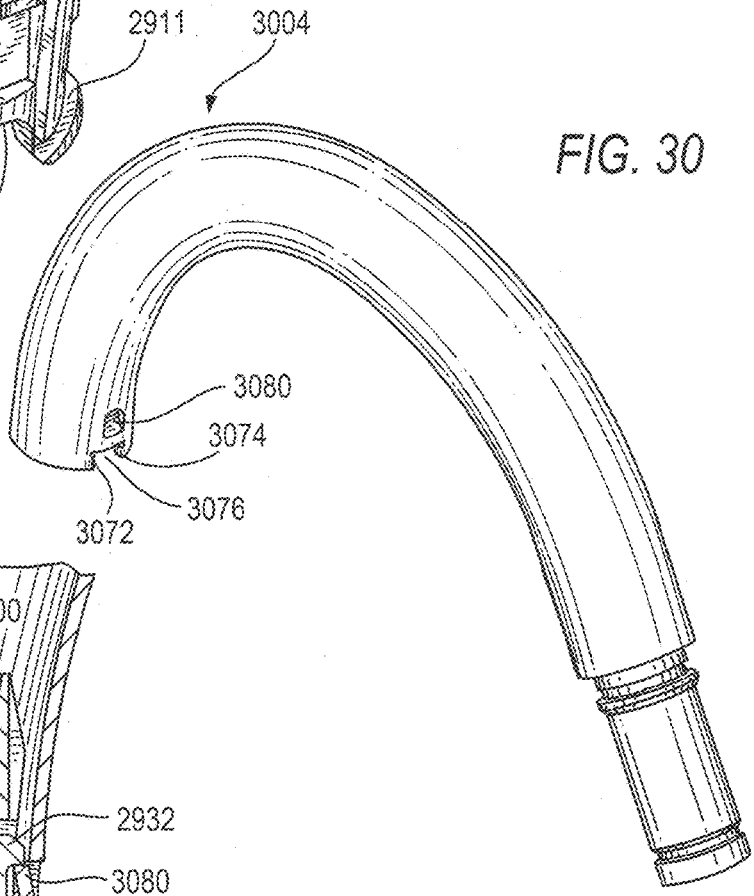
FIG. 30 is a perspective view of an alternate faucet spout, in accordance with an embodiment of the present invention.
Figure 31:
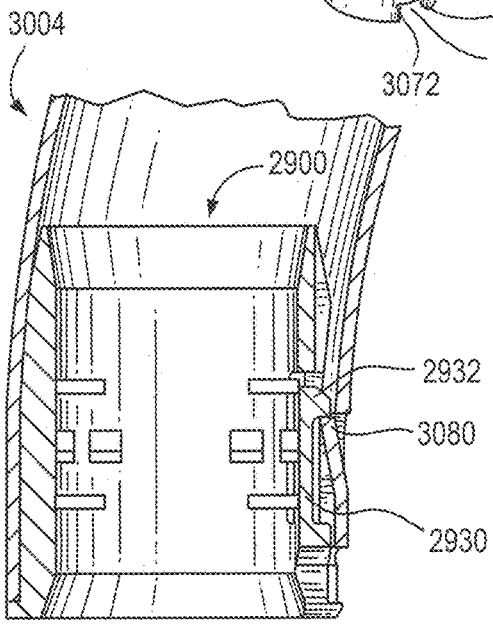
FIG. 31 is a cross-sectional view of the spout of FIG. 30 having the socket of FIG. 29 inserted therein, in accordance with an embodiment of the present invention.

FIG. 29 is a disassembled perspective view of an alternate socket 2900 of a magnetic docking system, in accordance with an embodiment of the present invention. FIG. 30 is a perspective view of a faucet spout 3004. FIG. 31 is a cross-sectional view of spout 3004 having socket 2900 inserted therein.

Socket 2900 may be similar to sockets 200 and 2500 of FIGS. 2*a*-2*d* and 25-28, and includes a shell 2910, a base portion 2911, a clip member 2930, a gap 2931, and a slot 2924. Clip member 2930 includes a protruding engagement member 2932 (e.g., similar to engagement member 232 of socket 200) defined to engage with a complementary feature of spout 3004. Socket 2900 also includes channels 2942 and 2944 (e.g. similar to channels 2542 and 2544) defined to slidably receive alignment features of spout 3004. Socket 2900 additionally includes grooves for retaining magnetic coupling elements. One of these grooves—groove 2912—is shown in FIG. 29. As with sockets 200 and 2500, the magnetic coupling elements may be respectively coupled to the grooves using any suitable method. It is to be understood that socket 2900 can alternatively include apertures (e.g., similar to apertures 212 and 214) for retaining the magnetic coupling elements.

Spout 3004 may be similar to spout 2604, and includes alignment members 3072 and 3074 formed at the end of the spout and a gap 3076 disposed therebetween. As with alignment members 2672 and 2674, alignment members 3072 and 3074 can be formed in any suitable manner. Spout 3004 also includes an engagement member 3080 disposed proximate the alignment members and that partially bends towards the center of the spout passageway. Engagement member 3080 can be formed in any suitable manner, including, for example, by punching or cutting the spout to create a flap-like portion of the spout, and bending the flap-like portion slightly towards the center of the spout passageway. Alignment members 3072 and 3074 prevent socket 2900 from being inserted into the spout end in any orientation other than that in which channel 2944 aligns with and slidably receives alignment member 3072, and channel 2942 aligns with and slidably receives alignment member 3074. When socket 2900 is fully inserted into the spout end, alignment members 3072 and 3074 are retained in respective portions of channels 2942 and 2944 proximate base 2911 of the socket, and engagement member 3080 clips onto an edge of engagement member 3080, securing socket 2900 in spout 3004.

Figure 32:
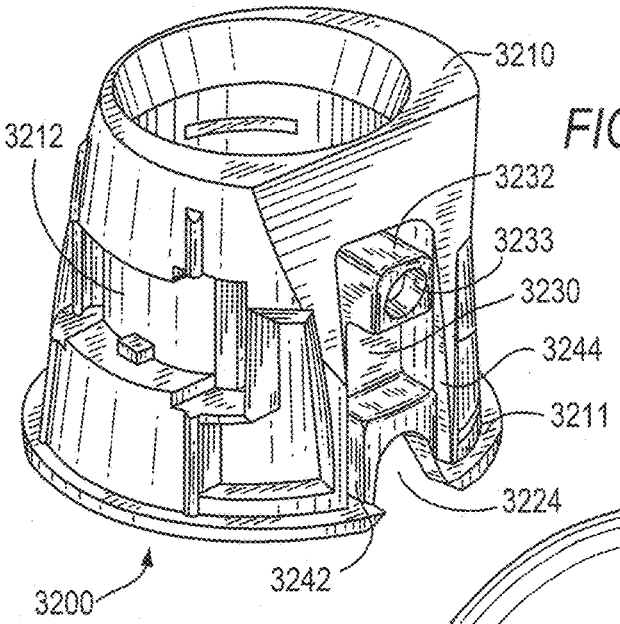
FIG. 32 is a disassembled perspective view of an alternate socket, in accordance with an embodiment of the present invention.
Figure 33:
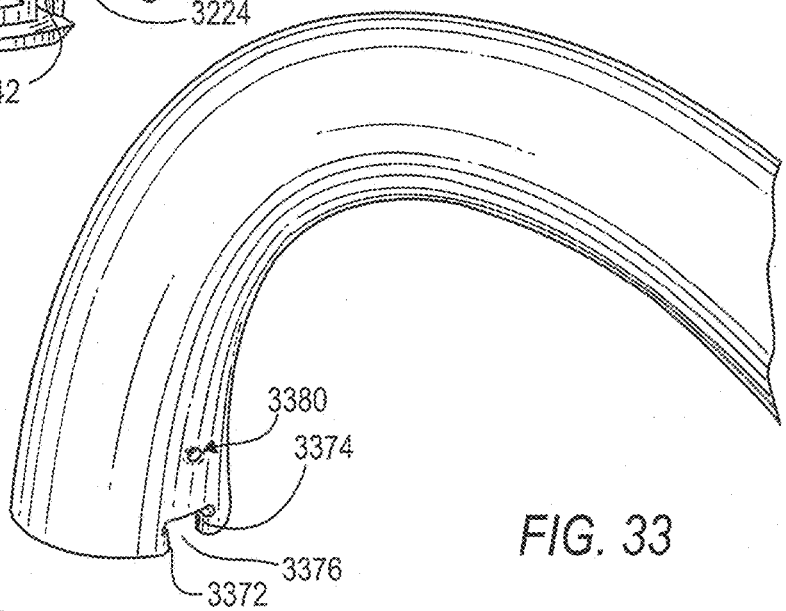
FIG. 33 is a perspective view of an alternate faucet spout, in accordance with an embodiment of the present invention.
Figure 34:
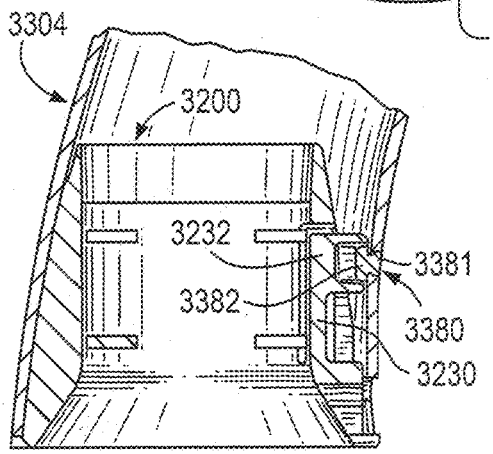
FIG. 34 is a cross-sectional view of the spout of FIG. 33 having the socket of FIG. 32 inserted therein, in accordance with an embodiment of the present invention.
Figure 35:
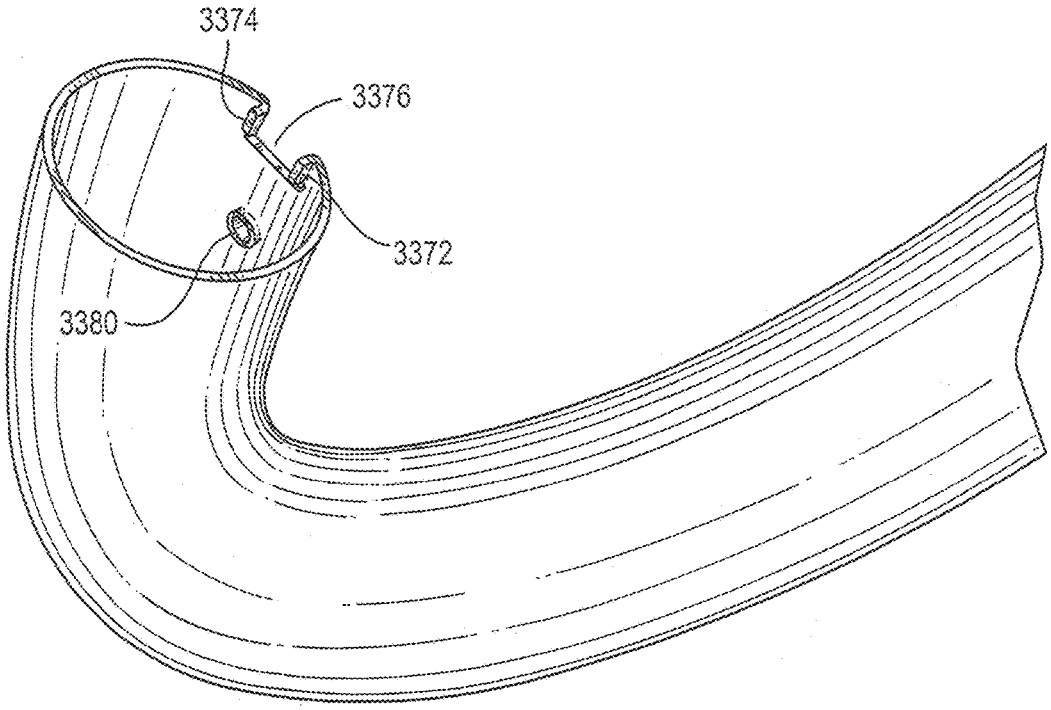
FIG. 35 is a bottom perspective view of the faucet spout of FIG. 33, in accordance with an embodiment of the present invention.

FIG. 32 is a disassembled perspective view of an alternate socket 3200 of a magnetic docking system, in accordance with an embodiment of the present invention. FIG. 33 is a perspective view of a faucet spout 3304. FIG. 34 is a cross-sectional view of spout 3304 having socket 3200 inserted therein. FIG. 35 is a bottom perspective view of faucet spout 3304.

Socket 3200 may be similar to sockets 200, 2500, and 2900 of FIGS. 2*a*-2*d* and 25-31, and includes a shell 3210, a base portion 3211, a clip member 3230, a gap 3231, and a slot 3224. Clip member 3230 includes a protruding engagement member 3232 similar to engagement member 232 of socket 200. However, in contrast to engagement member 232, clip member 3230 also includes a recess 3233 (e.g., a female connector) in engagement member 3232. Socket 3200 also includes channels 3242 and 3244 defined to slidably receive alignment features of spout 3304. Channels 3242 and 3244 may be similar to channels 2542 and 2544 of socket 2500 and channels 2942 and 2944 of socket 2900, but may not span the entire length between base 3211 and the opposite end of socket 3200. Socket 3200 additionally includes grooves for retaining magnetic coupling elements. One of these grooves—groove 3212—is shown in FIG. 32. As with sockets 200, 2500, and 2900, the magnetic coupling elements may be respectively coupled to the grooves using any suitable method. Additionally, it is to be understood that socket 3200 can alternatively include apertures (e.g., similar to apertures 212 and 214) for retaining the magnetic coupling elements.

Spout 3304 may be similar to spouts 2604 and 3004, and includes alignment members 3372 and 3374 formed at the end of the spout and a gap 3376 disposed therebetween. As with alignment members 2672 and 2674 and alignment members 3072 and 3074, alignment members 3372 and 3374 can be formed in any suitable manner. Spout 3304 also includes an engagement member 3380 disposed proximate the alignment members. Engagement member 3380 (which can be composed of any suitable material, such as, for example, brass) includes a tail 3381 and a head 3382, and can be coupled to spout 3304 in any suitable manner. In one embodiment, for example, spout 3304 can be punched or drilled to form an aperture, and engagement member 3380 (e.g., a male connector) can be inserted and retained therein (e.g., via press-fitting, adhesive, or the like). Alignment members 3372 and 3374 prevent socket 3200 from being inserted into the spout end in any orientation other than that in which channel 3244 aligns with and slidably receives alignment member 3372, and channel 3242 aligns with and slidably receives alignment member 3374. When socket 3200 is fully inserted in the spout end, alignment members 3372 and 3374 are retained in respective portions of channels 3242 and 3244 proximate base 3211 of the socket, and engagement member 3380 at least partially engages recess 3233 (e.g., as a male-to-female connection from the spout to the socket), securing socket 3200 in spout 3304.

Accordingly, it should be appreciated from the various embodiments described above, that the present invention provides an improved docking system having magnetically attractive components (coupled to the spout and the spray head of a pull-out style faucet spray) that retain the spray head in its proper docked position.

It will thus be seen that the aspects, features and advantages made apparent from the foregoing are efficiently attained and, since certain changes may be made without departing from the spirit and scope of the invention, it is intended that all matter contained herein shall be interpreted as illustrative and not in a limiting sense.

It is also to be understood that the following claims are intended to cover all of the generic and specific features of the invention herein described and all statements of the scope of the invention that, as a matter of language, might be said to fall therebetween.

What is claimed is:

1. A faucet comprising:

a spout having a male connector protruding toward an interior of the spout; and a socket insertable into the spout, the socket having a female connector and at least one magnetic coupling element, the female connector being configured to couple to the male connector to at least partially retain the socket when the socket is disposed in the spout.

2. The faucet of claim 1 further comprising:

a hose disposable in the spout and through the socket when the socket is inserted into the spout;

a pull-out spray head fluidly connectable to the hose and configured to dock to the spout; and at least one complementary magnetic coupling element configured to magnetically couple to the at least one magnetic coupling element of the socket when the pull-out spray head is docked.

3. The faucet of claim 2, wherein the hose includes a bonnet configured to couple to the pull-out spray head, and wherein the at least one complementary magnetic coupling element is disposed on the bonnet.

4. The faucet of claim 2, wherein the at least one complementary magnetic coupling element is disposed on an end of the pull-out spray head.

5. The faucet of claim 1, wherein the socket comprises at least one groove.

6. The faucet of claim 5, wherein the at least one magnetic coupling element is disposed in the at least one groove.

7. The faucet of claim 1, wherein the male connector is formed as a depression in an exterior surface of the spout that points inwardly into the interior of the spout.

8. The faucet of claim 1, further comprising an opening defined proximate an end of the spout, wherein the male connector comprises an engagement member having a tail disposed in the opening and a head pointing inwardly into the interior of the spout.

9. The faucet of claim 1, wherein the socket comprises a clip member.

10. The faucet of claim 9, wherein the female connector comprises a through-hole defined in the clip member.

11. The faucet of claim 9, wherein the clip member comprises an outwardly protruding engagement member.

12. The faucet of claim 11, wherein the female connector is a recess in the engagement member.

13. The faucet of claim 1, wherein the spout comprises at least one alignment member, and wherein the socket comprises at least one channel configured to receive the at least one alignment member.

14. A socket for facilitating docking of a pull-out spray head to a faucet spout, comprising: an outer surface having at least one groove defined therein; a clip member having a female connector; and at least one magnetic coupling element disposed in the at least one groove, the female connector being configured to couple to a male connector of a spout to at least partially retain the socket to the spout when the socket is disposed in the spout, and the at least one magnetic coupling element being configured to magnetically couple to at least one complementary magnetic coupling element disposed on one of a hose and a pull-out spray head.

15. The socket of claim 14, wherein the hose includes a bonnet configured to couple to the pull-out spray head, and wherein the at least one complementary magnetic coupling element is disposed on the bonnet.

16. The socket of claim 14, wherein the at least one complementary magnetic coupling element is disposed on an end of the pull-out spray head.

17. The socket of claim 14, wherein the female connector comprises a through-hole defined in the clip member.

18. The socket of claim 14, wherein the clip member is adjacent to the at least one groove.

19. The socket of claim 14, wherein the clip member comprises an outwardly protruding engagement member.

20. The socket of claim 19, wherein the female connector is a recess in the engagement member.

21. The socket of claim 14, wherein the outer surface comprises at least one channel configured to interact with at least one alignment member of the spout.

22. The socket of claim 21, wherein the at least one channel comprises two channels.

23. The socket of claim 22, wherein the clip member is disposed between the two channels.

24. The socket of claim 14, wherein the outer surface comprises at least one slot adjacent the clip member.

25. The socket of claim 24, wherein the at least one slot is configured to receive at least one alignment component on the spray head.

26. A faucet comprising:

a spout having an engagement member including an inwardly-extending portion of an inner wall of the spout; and a socket insertable into the spout, the socket having a clip member and at least one magnetic coupling element, the clip member being configured to engage the engagement member to at least partially retain the socket when the socket is disposed in the spout.

27. The faucet of claim 26, further comprising:

a hose disposable in the spout and through the socket; and a pull-out spray head fluidly connectable to the hose and configured to dock at an end of the spout, one of the hose and the pull-out spray head having at least one complementary magnetic coupling element configured to magnetically couple to the at least one magnetic coupling element of the socket.

* * * * *